US010497312B2

(12) United States Patent
Miyasaka et al.

(10) Patent No.: US 10,497,312 B2
(45) Date of Patent: Dec. 3, 2019

(54) ELECTRO-OPTICAL DEVICE AND ELECTRONIC APPARATUS

(71) Applicant: SEIKO EPSON CORPORATION, Tokyo (JP)

(72) Inventors: Mitsutoshi Miyasaka, Suwa (JP); Yoichi Momose, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/142,409

(22) Filed: Sep. 26, 2018

(65) Prior Publication Data

US 2019/0096325 A1 Mar. 28, 2019

(30) Foreign Application Priority Data

Sep. 27, 2017 (JP) ..... 2017-185867

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2320/0666* (2013.01); *G09G 2330/022* (2013.01)

(58) Field of Classification Search
CPC ..... G09G 3/3233; G09G 2300/0842; G09G 3/3266; G09G 3/3275; G09G 2320/0666; G09G 2330/022
See application file for complete search history.

(56) References Cited

U.S. PATENT DOCUMENTS 8,760,376 B2 * 6/2014 Koyama ..... G09G 3/3266 345/100
2002/0039087 A1 * 4/2002 Inukai ..... G09G 3/3266 345/76
2002/0070913 A1 6/2002 Kimura et al.
2002/0140642 A1 10/2002 Okamoto
2003/0057423 A1 * 3/2003 Shimoda ..... H01L 21/6835 257/80
2004/0047530 A1 3/2004 Hara et al.

FOREIGN PATENT DOCUMENTS

JP 2002-287695 A 10/2002
JP 2004-62161 A 2/2004
JP 2004-62163 A 2/2004
JP 2004-62199 A 2/2004
JP 2004-163601 A 6/2004

* cited by examiner

*Primary Examiner* — Gerald Johnson
(74) *Attorney, Agent, or Firm* — Oliff PLC

(57) ABSTRACT

An electro-optical device includes a scan line, a data line, a pixel circuit provided to correspond to an intersection of the scan line and the data line, a low potential line, and a high potential line with a different potential from the low potential line. The pixel circuit includes a light emitting element, a memory circuit including a first transistor, a second transistor arranged between the memory circuit and the data line, and a third transistor. A source of the first transistor is electrically connected to the low potential line, and the light emitting element and the third transistor are arranged in series between a drain of the first transistor and the high potential line.

11 Claims, 17 Drawing Sheets

ELECTRO-OPTICAL DEVICE AND ELECTRONIC APPARATUS

The present application is based on and claims priority from JP Application Serial Number 2017-185867, filed Sep. 27, 2017, the disclosure of which is hereby incorporated by reference herein in its entirety.

BACKGROUND

1. Technical Field

The disclosure relates an electro-optical device and an electronic apparatus.

2. Related Art

In recent years, head-mounted displays (HMDs), a type of electronic device that enables formation and viewing of a virtual image by directing image light from an electro-optical device to the pupil of an observer, have been proposed. One example of the electro-optical device used in these electronic devices is an organic electro-luminescence (EL) device that includes an organic EL element as a light-emitting element. The organic EL devices used in head-mounted displays are required to provide high resolution (fine pixels), multiple grey scales of display, and low power consumption.

In organic EL devices in prior art, when a selecting transistor turns to an ON-state according to a scan signal supplied to a scan line, an electrical potential based on an image signal supplied from a data line is held in a capacitive element connected to the gate of a driving transistor. When the driving transistor turns to an ON-state in response to the electrical potential maintained in the capacitive element, that is, the gate potential of the driving transistor, an electric current flows through the organic EL element depending on the gate potential of the driving transistor and thus the organic EL element emits light with luminance depending on the electric current.

In this way, the organic EL device in prior art displays a grey scale using an analog drive method that controls the current flowing through the organic EL element depending on the gate potential of the driving transistor. This causes problems of variation in brightness and grey scale shift among pixels because of variation in transfer characteristics and threshold voltage of the driving transistor, and thus reduces display quality. To address the above-described problems, it is conceivable to provide an organic EL device including a compensation circuit that compensates for variation in the transfer characteristics and threshold voltage of the driving transistor (for example, refer to JP-A-2004-062199).

However, when such a compensation circuit is provided as described in JP-A-2004-062199, a current also flows through the compensation circuit, thus increasing power consumption. Furthermore, in order to achieve multiple grey scales display, the analog driving approaches in prior art require a capacitive element with large capacitance to keep image signals. This requirement is incompatible with the requirements for high resolution that means fine pixels and may result in an increased power consumption due to charging and discharging of the capacitive element. In other words, in the related art, it may be difficult to achieve an electro-optical device that can display a high quality image having a high resolution and multiple grey scales at a low power consumption.

SUMMARY

The disclosure may be implemented as several exemplary embodiments or application examples provided below.

APPLICATION EXAMPLE 1

An electro-optical device according to Application Example 1 includes a scan line, a data line, a pixel circuit provided to correspond to an intersection of the scan line and the data line, a first potential line that supplies a first potential, and a second potential line that supplies a second potential, which is a different from the first potential. The pixel circuit includes a light emitting element, a memory circuit including a first transistor, a second transistor arranged between the memory circuit and the data line, and a third transistor. A source of the first transistor is electrically connected to the first potential line. The light emitting element and the third transistor are arranged in series between a drain of the first transistor and the second potential line.

According to the configuration of Application Example 1, each pixel circuit includes the memory circuit including the first transistor. The first transistor, the light emitting element, and the third transistor are arranged between the first potential line and the second potential line. This is a good configuration for a digital drive method for displaying multiple grey scales. The digital drive method uses binary states, i.e. ON- and OFF-states and controls the time ratio between emission and non-emission of the light emitting element. Accordingly, the electro-optical device becomes less susceptible to variation in transfer characteristics and threshold voltage of each transistor, such that variation in brightness and grey scale shift among pixels can be reduced without a compensation circuit. Furthermore, the digital drive method can readily increase the number of grey scales without any capacitive elements by increasing the number of sub-fields in a field during which a single image is displayed. A sub-field is a basic period for controlling emission and non-emission of the light emitting element. Thus, finer pixels and a higher resolution can be achieved. Also, the power consumption due to charging and discharging of the capacitive element can be reduced. As a result, an electro-optical device that can display a high-quality image with a high resolution and multiple grey scales at low power consumption can be achieved.

APPLICATION EXAMPLE 2

In the electro-optical device according to the application example described above, a drain of the third transistor and the light emitting element is electrically connected to each other.

According to the configuration of Application Example 2, when the third transistor is in an OFF-state, a current does not flow through the light emitting element. Accordingly, writing a signal to the memory circuit while the third transistor is in the OFF-state makes it possible to reliably write or rewrite the signal to the memory circuit at low power consumption. Thus, the current configuration can prevent the electro-optical device from displaying a wrong or low-quality image due to incorrect writing of signals to the memory circuit.

APPLICATION EXAMPLE 3

In the electro-optical device according to the application example described above, an ON-resistance of the third transistor is sufficiently lower than an ON-resistance of the light emitting element.

According to the configuration of Application Example 3, while both the third transistor and the light emitting element are in ON-state to cause the light emitting element to emit light, the third transistor is substantially operated in the linear region. Hereinafter, a transistor operated in the linear region is simply referred to a linear operation. As a result, most of a potential drop occurring in the light emitting element and the third transistor is applied to the light emitting element, resulting in a less susceptible state to variation in the threshold voltage while the light emitting element is emitting light. Therefore, variation in brightness and grey scale shift among pixels can be reduced.

APPLICATION EXAMPLE 4

In the electro-optical device according to the application example described above, an ON-resistance of the first transistor is lower than or equal to an ON-resistance of the third transistor.

According to the configuration of Application Example 4, the current flow ability of the first transistor is larger than the current flow ability of the third transistor, thus enabling reduction of the risk that the signal stored in the memory circuit may be rewritten when the light emitting element emits light. Thus, a high-quality image without any display errors can be achieved. Moreover, since the ON-resistance of the third transistor is sufficiently lower than the ON-resistance of the light emitting element, both the first and third transistors are operated in the linear region while the light emitting element emits light. As a result, most of a potential drop occurring in the light emitting element, the first transistor, and the third transistor, is applied to the light emitting element, resulting in a less susceptible state to variation in the threshold voltage of the first transistor or the third transistor. Thus, variation in brightness and grey scale shift among pixels can be reduced.

APPLICATION EXAMPLE 5

In the electro-optical device according to the application example described above, the third transistor is in an OFF-state while the second transistor is in an ON-state.

According to the configuration of Application Example 5, when the second transistor is in the ON-state to write a signal to the memory circuit, the third transistor is in the OFF-state to prevent a current from flowing through the light emitting element. As a result, the signal can be written fast and reliably to the memory circuit with low power consumption. Thus, a high-quality image without any display errors can be achieved.

APPLICATION EXAMPLE 6

In the electro-optical device according to the application example described above, the second transistor is in an OFF-state while the third transistor is in an ON-state.

According to the configuration of Application Example 6, when the third transistor is in the ON-state to cause the light emitting element to emit light, the second transistor is in the OFF-state to prevent a signal from being written to the memory circuit. As a result, display errors caused by the signal erroneously rewritten to the memory circuit can be prevented. Moreover, controlling non-emission and emission periods in a time-division manner makes it possible to display the grey scales accurately. This is because the light is not emitted and the signal is written to the memory circuit in the non-emission period; by contrast the light is emitted and the signal is hold in the memory circuit in the emission period in the current configuration.

APPLICATION EXAMPLE 7

The electro-optical device according to the application example described above further includes an enable line. A gate of the second transistor is electrically connected to the scan line. A gate of the third transistor is electrically connected to the enable line.

According to the configuration of Application Example 7, the second transistor and the third transistor are independently controlled through the scan line and the enable line, respectively. Thus, for example, the third transistor turns into an OFF-state after the second transistor turns into an ON-state, or the third transistor turns into an ON-state after the second transistor turns into an OFF-state.

APPLICATION EXAMPLE 8

In the electro-optical device according to the application example described above, an inactive signal for bringing the third transistor into an OFF-state is supplied to the enable line during a first period in which a selection signal for turning the second transistor into an ON-state is supplied to the scan line.

According to the configuration of Application Example 8, the third transistor is in the OFF-state during the first period during which the second transistor is in the ON-state, such that the first period serves as a signal write period during which a signal is written to the memory circuit while the light emitting element is not emitting light.

APPLICATION EXAMPLE 9

In the electro-optical device according to the application example described above, a non-selection signal for turning the second transistor into an OFF-state is supplied to the scan line during a second period in which an active signal for turning the third transistor into an ON-state is supplied to the enable line.

According to the configuration of Application Example 9, the second period serves as a light emission period, i.e. a display period, since the second transistor is in the OFF-state and the third transistor is in the ON-state during the second period. During the second period the light emitting element emits light while the memory circuit holds the signal. Furthermore, this configuration makes it possible to make the second period shorter than the first period by controlling the length of the first period and the second period. As a result, the electro-optical device displays a large number of grey scales using a time-division driving manner. Moreover, driving of the electro-optical device is facilitated in this configuration, because a control signal supplied to the enable lines is shared among a plurality of pixels. Specifically, the electro-optical device is readily driven to display a short sub-field in which the light emission period is even shorter than one vertical period during which selection of each of a plurality of scan lines is completed.

APPLICATION EXAMPLE 10

In the electro-optical device according to the application example described above, a gate of the second transistor and a gate of the third transistor are electrically connected to the scan line, and the second transistor and the third transistor have polarities opposite to each other.

According to the configuration of Application Example 10, since one of the second transistor and the third transistor is P-type and the other is N-type, a signal supplied from the scan line enables one transistor to be in an ON-state and the other transistor to be in an OFF-state. Accordingly, the scan line also functions as the enable line, thus enabling reduction of the number of wires and thus, the number of wiring layers. As a result, the production yield of the electro-optical device can be improved. In addition, with a reduced number of wires, the area that shields light can be decreased to achieve an electro-optical device with a high resolution and fine pixels.

APPLICATION EXAMPLE 11

An electronic apparatus according to Application Example 11 includes the electro-optical device described in the application examples.

According to the configuration of Application Example 11, a high-quality image can be displayed on the electronic apparatus such as a head-mounted display.

BRIEF DESCRIPTION OF THE DRAWINGS

Embodiments of the disclosure will be described with reference to the accompanying drawings, wherein like numbers reference like elements.

DESCRIPTION OF EXEMPLARY EMBODIMENTS

Figure 1:
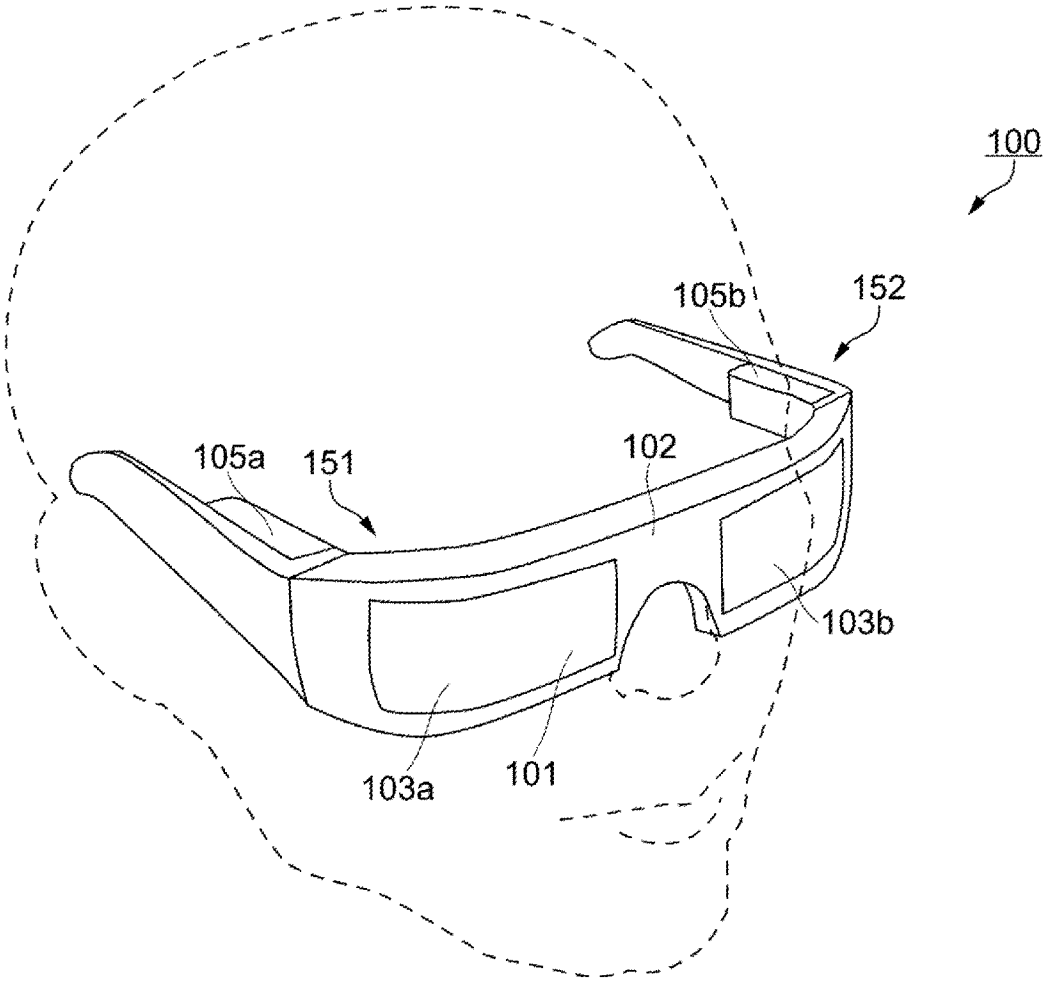
FIG. 1 schematically illustrates an electronic apparatus according to some exemplary embodiments.

Several exemplary embodiments of the disclosure will be described below with reference to the drawings. In the drawings referred to below, layers, members, and the like are not to scale in order to make the layers, members, and the like recognizable in size.

Outline of Electronic Apparatus

Outline of an electronic apparatus will now be described with reference to FIG. 1. FIG. 1 schematically illustrates an electronic apparatus according to some exemplary embodiments.

Figure 3:
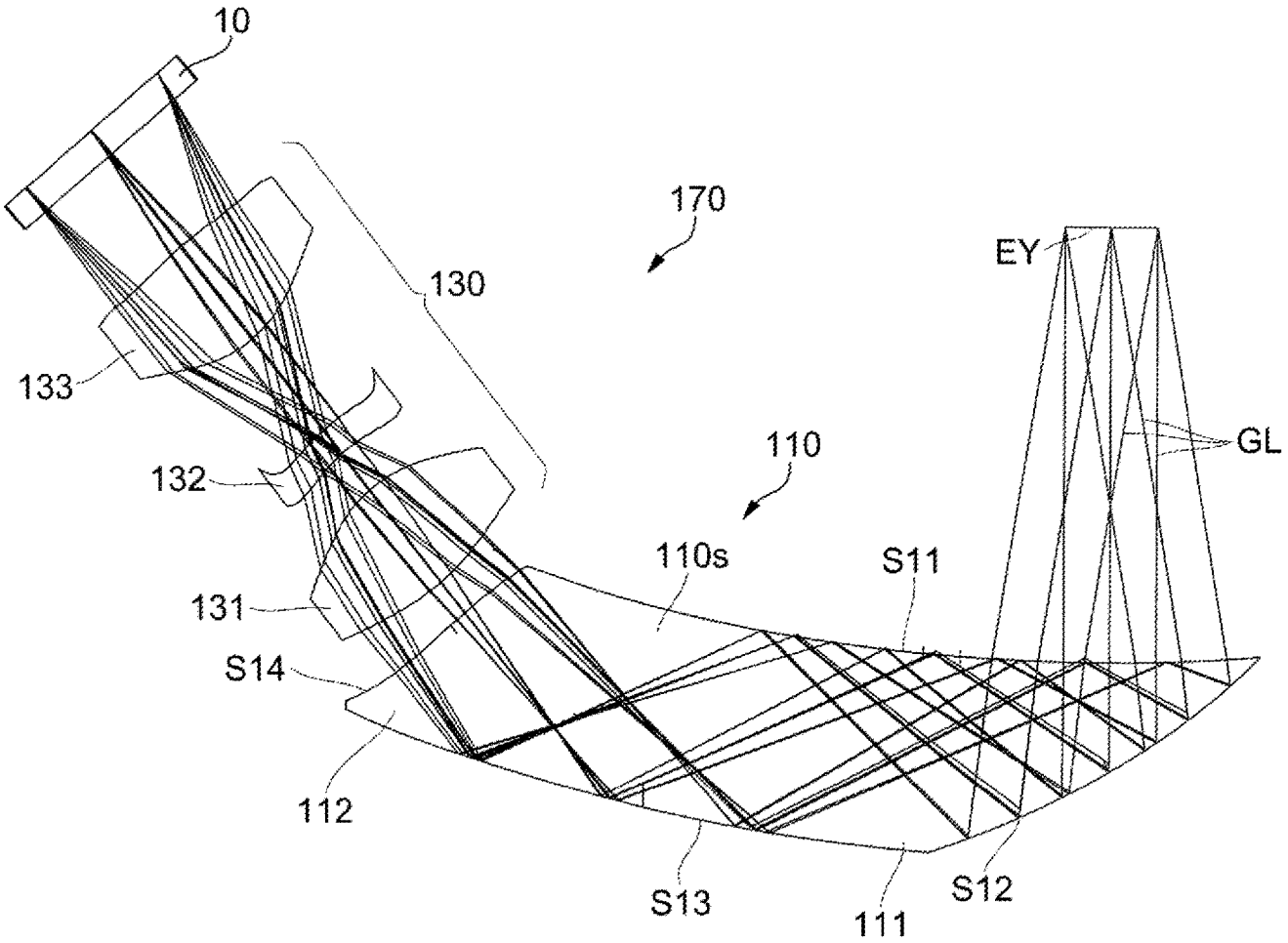
FIG. 3 illustrates an optical system of the electronic apparatus according to some exemplary embodiments.

A head-mounted display 100 is an example of the electronic apparatus according to some exemplary embodiments, and includes an electro-optical device 10 (refer to FIG. 3). As illustrated in FIG. 1, the head-mounted display 100 has an appearance like glasses. The head-mounted display 100 allows a user who wears the head-mounted display 100 to view image light GL of an image (refer to FIG. 3) and allows the user to view outside light as a see-through image. Specifically, the head-mounted display 100 has a see-through function that displays a superimposition of the outside light and the image light GL, has a wide angle of view and high performance, and is also small and light.

The head-mounted display 100 includes a see-through member 101 that covers the eyes of the user, a frame 102 that supports the see-through member 101, and a first built-in device unit 105*a* and a second built-in device unit 105*b* that are attached to the frame 102 over an area extending from cover portions at respective ends of the frame 102 over a portion of temples behind.

The see-through member 101 is a thick, curved optical member, namely a transparent eye cover, covering the eyes of the user and is separated into a first optical portion 103*a* and a second optical portion 103*b*. As seen on the left side in FIG. 1, a first display apparatus 151, which includes a combination of the first optical portion 103*a* and the first built-in device unit 105*a*, is a part to display a virtual image for the right eye as a see-through image and functions by itself as an electronic apparatus with a display function. As seen on the right side in FIG. 1, a second display apparatus 152, which includes a combination of the second optical portion 103*b* and the second built-in device unit 105*b*, is a part to display a virtual image for the left eye as a see-through image and functions by itself as an electronic apparatus with a display function. Each of the first display apparatus 151 and the second display apparatus 152 has the electro-optical device 10 (refer to FIG. 3) incorporated therein.

Internal Structure of Electronic Apparatus

Figure 2:
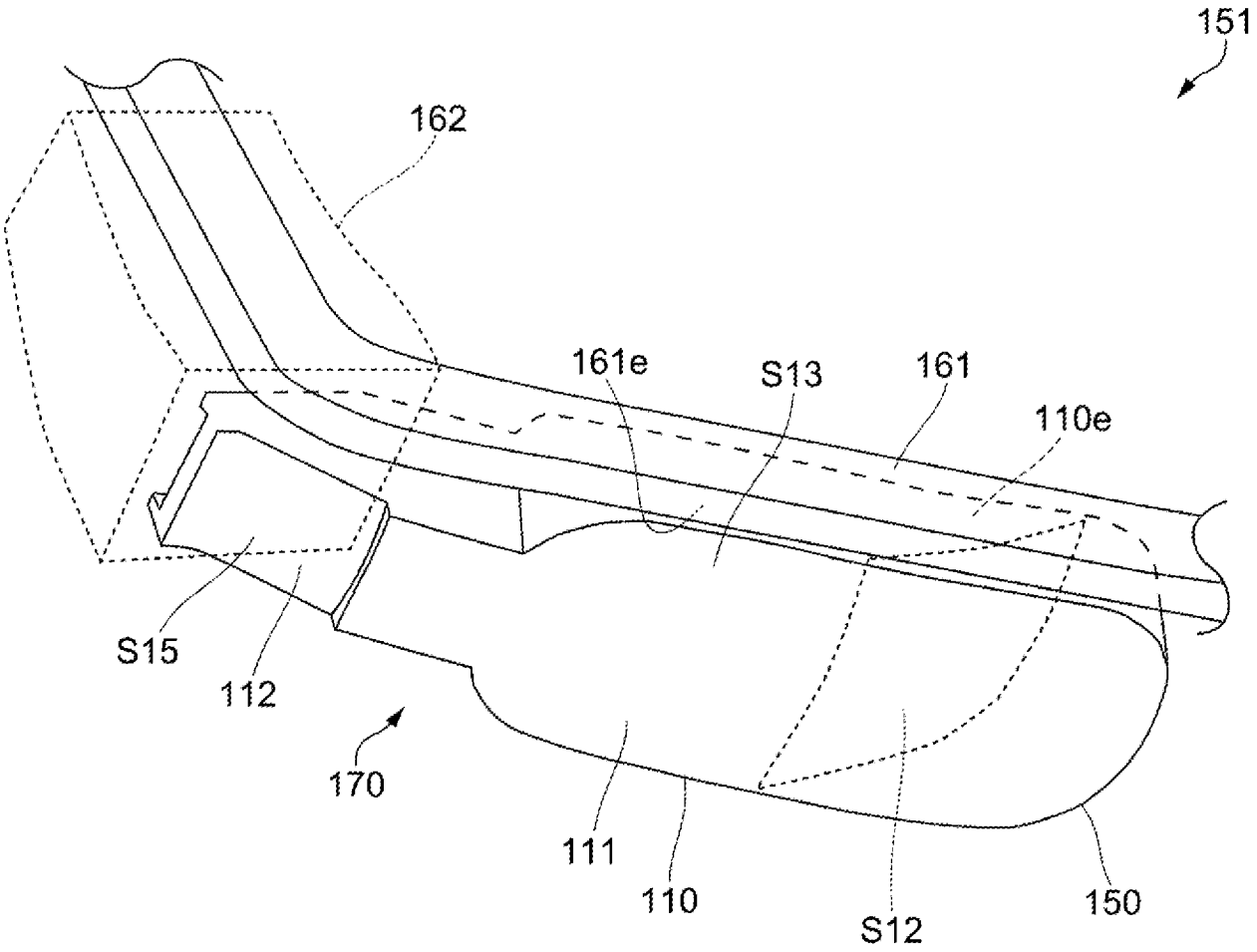
FIG. 2 illustrates an internal structure of the electronic apparatus according to some exemplary embodiments.

FIG. 2 illustrates an internal structure of the electronic apparatus according to one exemplary embodiment. FIG. 3 illustrates an optical system of the electronic apparatus according to one exemplary embodiment. The internal structure and the optical system of the electronic apparatus will now be described with reference to FIG. 2 and FIG. 3. While FIG. 2 and FIG. 3 illustrate the first display apparatus 151 as an example of the electronic apparatus, the second display apparatus 152 is symmetrical to the first display apparatus 151 and has substantially the same structure. Accordingly, only the first display apparatus 151 will be described here and detailed description of the second display apparatus 152 will be omitted.

As illustrated in FIG. 2, the first display apparatus 151 includes a projection see-through device 170 and the electro-optical device 10 (refer to FIG. 3). The projection see-through device 170 includes a prism 110 to serve as a light guide member, a transparent member 150, and a projector lens 130 for image formation (refer to FIG. 3). The prism 110 and the transparent member 150 are integrated together by bonding and are firmly fixed to the bottom of a frame 161 such that a top face 110*e* of the prism 110 and a bottom face 161*e* of the frame 161 are held in contact with each other, for example.

The projector lens 130 is fixed to an end of the prism 110 through a lens barrel 162 that houses the projector lens 130. The prism 110 and the transparent member 150 in the projection see-through device 170 correspond to the first optical portion 103*a* shown in FIG. 1. The projector lens 130 and the electro-optical device 10 in the projection see-through device 170 correspond to the first built-in device unit 105*a* shown in FIG. 1.

The prism 110 in the projection see-through device 170 is an arc-shaped member that is curved along the face of the user when viewed in a plan view and may be considered to be formed of a first prism portion 111 on the central side closer to the nose and a second prism portion 112 on the peripheral side away from the nose. The first prism portion 111 is disposed on the light emission side and has a first face S11 (refer to FIG. 3), a second face S12, and a third face S13, each of which serves as a side face having an optical function.

The second prism portion 112 is disposed on the light incident side and has a fourth face S14 (refer to FIG. 3) and a fifth face S15, each of which serves as a side face having an optical function. Of these faces, the first face S11 and the fourth face S14 are adjacent to each other, the third face S13 and the fifth face S15 are adjacent to each other, and the second face S12 is disposed between the first face S11 and the third face S13. Also, the prism 110 has the top face 110*e* that is adjacent to the first face S11 to the fourth face S14.

The prism 110 is formed from a resin material with high optical transparency in a visible range and is molded, for example, by pouring a thermoplastic resin into a mold and curing the resin. While a body portion 110*s* (refer to FIG. 3) of the prism 110 is an integrally formed article, it can be considered to be formed of the first prism portion 111 and the second prism portion 112. The first prism portion 111 can guide and output the image light GL and also allows outside light to be seen-through. The second prism portion 112 can receive and guide the image light GL.

The transparent member 150 is integrally fixed to the prism 110. The transparent member 150 is a member that served as an auxiliary prism and aids in the see-through function of the prism 110. The transparent member 150 has high optical transparency in a visible range and is formed from a resin material with a refractive index that is substantially equal to the refractive index of the body portion 110*s* of the prism 110. The transparent member 150 is formed, for example, by molding thermoplastics resin.

As illustrated in FIG. 3, the projector lens 130 includes three lenses 131, 132, and 133 that are arranged along the optical axis on the light input side. Each of the lenses 131, 132, and 133 is rotationally symmetrical with respect to the central axis of the light input surfaces of the lenses. At least one of the lenses 131, 132, and 133 is an aspherical lens.

The projector lens 130 directs the image light GL emitted from the electro-optical device 10 into the prism 110 to re-form an image on an eye EY. In other words, the projector lens 130 is a relay optical system to re-form an image of the image light GL emitted from each pixel of the electro-optical device 10 on the eye EY through the prism 110. The projector lens 130 is held in the lens barrel 162 and the electro-optical device 10 is fixed to an end of the lens barrel 162. The second prism portion 112 of the prism 110 is connected to the lens barrel 162, which holds the projector lens 130, to indirectly support the projector lens 130 and the electro-optical device 10.

An electronic apparatus of a type that is mounted on the head of the user to cover the eyes, such as the head-mounted display 100, is required to be small and light. The electro-optical device 10 used in the electronic apparatus such as the head-mounted display 100 is required to provide high resolution, fine pixels, multiple grey scales of display, and low power consumption.

Configuration of Electro-optical Device

First Exemplary Embodiment

Figure 4:
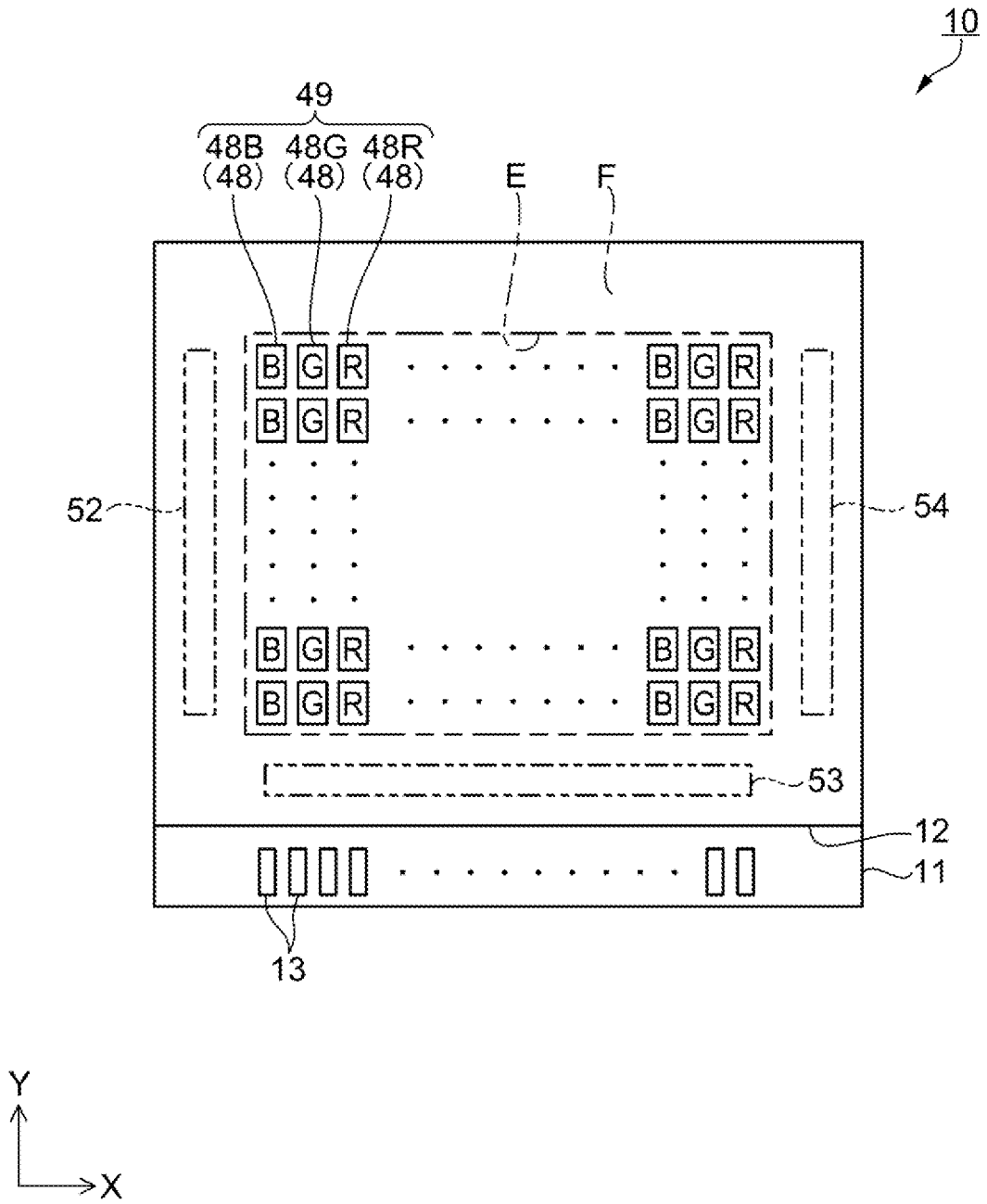
FIG. 4 is a schematic plan view illustrating a configuration of an electro-optical device according to First Exemplary Embodiment.

A configuration of the electro-optical device will now be described with reference to FIG. 4. FIG. 4 is a schematic plan view illustrating a configuration of the electro-optical device according to First Exemplary Embodiment. An organic EL device that includes an organic EL element as a light emitting element is explained as an example of the electro-optical device 10 in First Exemplary Embodiment. As illustrated in FIG. 4, the electro-optical device 10 according to First Exemplary Embodiment includes an element substrate 11 and a protective substrate 12. The element substrate 11 is provided with a color filter (not illustrated). The element substrate 11 and the protective substrate 12 are arranged to face each other and are bonded together with filler (not illustrated).

The element substrate 11 is formed from, for example, a single-crystal semiconductor substrate (e.g., a single-crystal silicon wafer). The element substrate 11 has a display region E and a non-display region F surrounding the display region E. In the display region E, for example, sub-pixels 48B that emit blue light (B), sub-pixels 48G that emit green light (G), and sub-pixels 48R that emit red light (R) are arranged in a matrix for example. A light emitting element 20 (refer to FIG. 6) is provided in each of the sub-pixels 48B, the sub-pixels 48G, and the sub-pixels 48R. In the electro-optical device 10, a pixel 49 that includes the sub-pixel 48B, the sub-pixel 48G, and the sub-pixel 48R is a display unit to show full color images.

In this specification, the sub-pixel 48B, the sub-pixel 48G, and the sub-pixel 48R are not distinguished from one another and may be collectively referred to as a sub-pixel 48. The display region E is a region where light emitted from the sub-pixel 48 is transmitted and contributes to display. The non-display region F is a region where light emitted from the sub-pixel 48 is not transmitted and does not contribute to display.

The element substrate 11 is larger than the protective substrate 12 and a plurality of external connection terminals 13 are arranged along a first side of the element substrate 11 which extends out of the protective substrate 12. A data line drive circuit 53 is provided between the display region E and the plurality of external connection terminals 13. A scan line drive circuit 52 is provided between the display region E and a second side that is another side perpendicular to the first side. An enable line drive circuit 54 is provided between the display region E and a third side that is perpendicular to the first side and opposite to the second side.

The protective substrate 12 is smaller than the element substrate 11 and is disposed so that the external connection terminals 13 are exposed. The protective substrate 12 is a light transparent substrate such as a quartz substrate or a glass substrate, for example. The protective substrate 12 is disposed to face at least the display region E to protect the light emitting elements 20 disposed in the sub-pixels 48 in the display region E from being damaged.

The color filter may be provided on the light emitting elements 20 in the element substrate 11 or it may be provided on the protective substrate 12. On the other hand, the color filter may not be required in such a configuration in which light corresponding to each color is emitted from the light emitting element 20. The protective substrate 12 may not be required, and instead of the protective substrate 12, a protective layer to protect the light emitting element 20 may be provided on the element substrate 11.

In this specification, a direction along the first side on which the external connection terminals 13 are arranged is referred to as X direction, and a direction along the other two sides that are the second and third sides is referred to as Y direction. The second and third sides are perpendicular to the first side and are opposed each other. In this application the X direction is referred to as a row direction and the Y direction is referred to as a column direction. In First Exemplary Embodiment the sub-pixels 48 are arranged in a so-called stripe arrangement in which the sub-pixels 48 that emit the same color are arranged in the column direction, i.e. the Y direction, and the sub-pixels 48 that emit different colors are arranged in the row direction, i.e. the X direction.

The arrangement of the sub-pixels 48 in the row direction (the X direction) is not limited to the order of B, G, and R as illustrated in FIG. 4 and may be in the other order such as R, G, and B for example. The arrangement of the sub-pixels 48 is not limited to the stripe arrangement and may be a delta arrangement, a Bayer arrangement, or an S-stripe arrangement. In addition, the sub-pixels 48B, the sub-pixels 48G, and the sub-pixels 48R are neither limited to the same shape nor to the same size.

Circuit Configuration of Electro-Optical Device

Figure 5:
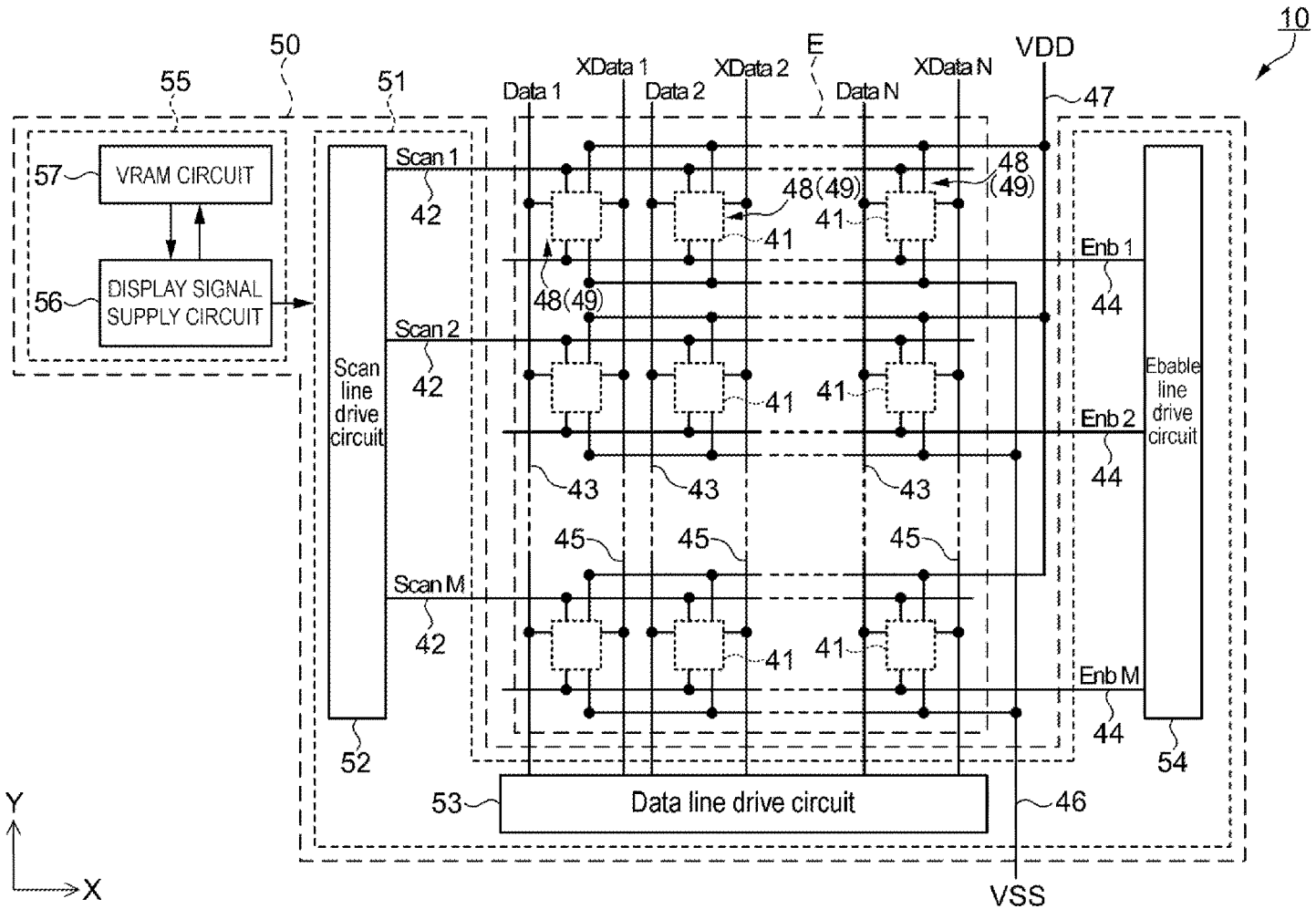
FIG. 5 is a circuit block diagram of the electro-optical device according to one exemplary embodiment.

A circuit configuration of the electro-optical device will now be described with reference to FIG. 5. FIG. 5 is a circuit block diagram of the electro-optical device according to First Exemplary Embodiment. As illustrated in FIG. 5 a plurality of scan lines 42, a plurality of data lines 43, and a plurality of sub-pixels 48 are formed in the display region E of the electro-optical device 10. The scan lines 42 and the data lines 43 cross each other. The sub-pixels 48 are arranged in a matrix corresponding to the respective intersections of the scan lines 42 and the data lines 43. Each sub-pixel 48 possesses a pixel circuit 41 that includes the light emitting element 20, a third transistor 33 (refer to FIG. 8), and the like.

In the display region E, enable lines 44 are formed corresponding to the respective scan lines 42. The scan lines 42 and the enable lines 44 extend in the row direction. Also formed in the display region E are complementary data lines 45 that correspond to the respective data lines 43. The data lines 43 and the complementary data lines 45 extend in the column direction.

Letting M and N be each an integer of two or greater, in the electro-optical device 10 sub-pixels 48 form a matrix of M rows×N columns in the display region E. Also, M scan lines 42, M enable lines 44, N data lines 43, and N complementary data lines 45 are formed in the display region E. In First Exemplary Embodiment M=720 and N=1280×p as an example. Here, p is an integer of one or more and indicates the number of basic colors for display. In First Exemplary Embodiment p=3, as an example, that is, the basic colors for display are three colors of R, G, and B.

The electro-optical device 10 includes a driving unit 50 outside the display region E. The driving unit 50 supplies various signals to the respective pixel circuits 41 arranged in the display region E, such that an image is displayed in the display region E, using the pixels 49 as display units. In First Exemplary Embodiment, each of the pixels 49 includes the sub-pixels 48 for the three colors. The driving unit 50 includes a drive circuit 51 and a control unit 55. The control unit 55 supplies a display signal to the drive circuit 51. The drive circuit 51 supplies a drive signal to each pixel circuit 41 via the plurality of scan lines 42, the plurality of data lines 43, and the plurality of enable lines 44. The drive signal is based on the display signal.

The drive circuit 51 includes the scan line drive circuit 52, the data line drive circuit 53, and the enable line drive circuit 54. The drive circuit 51 is provided in the non-display region F (refer to FIG. 4). In First Exemplary Embodiment, the drive circuit 51 and the pixel circuit 41 are formed on the element substrate 11 as illustrated in FIG. 4. In First Exemplary Embodiment, a single-crystal silicon wafer is used for the element substrate 11. Specifically, the drive circuit 51, the pixel circuit 41, and the like are formed from elements, such as transistors, which are formed on the single-crystal silicon wafer.

The scan lines 42 are electrically connected to the scan line drive circuit 52. The scan line drive circuit 52 outputs a scan signal (Scan) to each scan line 42. The scan signal does or does not select the pixel circuit 41 in the row direction. The scan line 42 transmits the scan signal to the pixel circuit 41. In other words, the scan signal has a selection-state and a non-selection-state. Each scan line 42 is appropriately selected, receiving the scan signal from the scan line drive circuit 52.

A low potential line 46 and a high potential line 47 are arranged in the non-display region F. The low potential line 46 supplies a low potential (VSS) to each pixel circuit 41 whereas the high potential line 47 supplies a high potential (VDD) to each pixel circuit 41. While the low potential line 46 and the high potential line 47 each extend in the row direction as an example in First Exemplary Embodiment, they may extend in the column direction or they may be arranged in the row and column directions to form a matrix.

As described later, when both a second transistor 32 and a complementary second transistor 37 are N-type (refer to FIG. 8), the scan signal in the selection-state, i.e. a selection signal, is the high potential VDD (for example VDD=5 V). On the other hand, the scan signal in the non-selection-state, i.e. a non-selection signal, is the low potential VSS (for example VSS=0 V).

Figure 6:
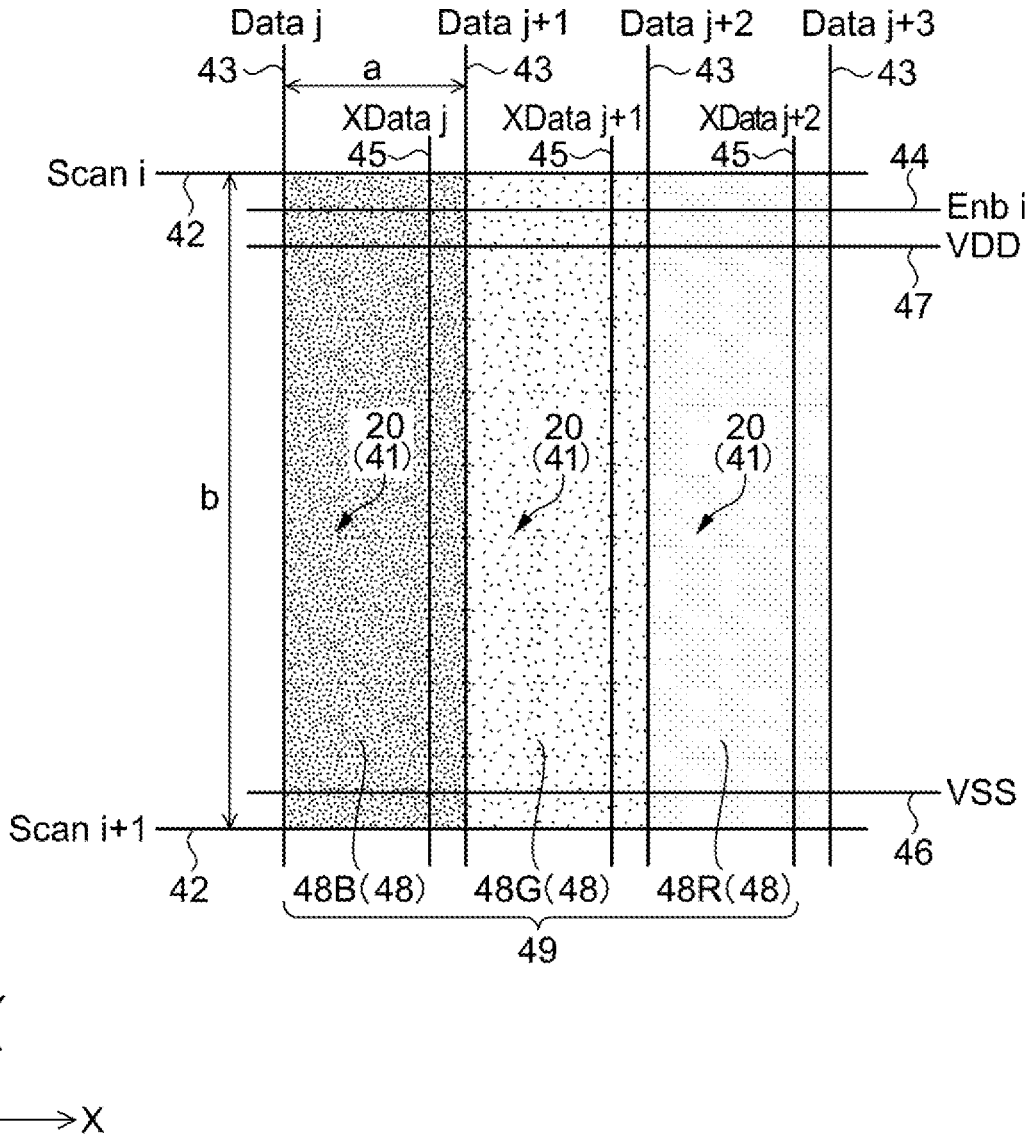
FIG. 6 illustrates a configuration of a pixel according to one exemplary embodiment.

As illustrated in FIG. 6, in order to specify a scan signal supplied to the scan line 42 in the first row among the M scan lines 42 the scan signal in the first row is indicated as Scan 1; a scan signal supplied to the scan line 42 in the i-th row is indicated as Scan i to specify the scan signal in the i-th row; and a scan signal supplied to the scan line 42 in the M-th row is indicated as Scan M to specify the scan signal in the M-th row. The scan line drive circuit 52 includes a shift register circuit (not illustrated). Signals shifted in the shift register circuit are output from each stage as shift-output signal. The scan signals Scan 1 to Scan M are generated from the shift-output signals.

The data lines 43 and the complementary data lines 45 are electrically connected to the data line drive circuit 53. The data line drive circuit 53 may include a shift register circuit, a decoder circuit, a multiplexer circuit, or the like (not illustrated). The data line drive circuit 53 supplies image signals (Data) to each of the N data lines 43 and supplies complementary image signals to each of the N complementary data lines 45, in synchronization with the selection of the scan lines 42. In First Exemplary Embodiment, the image signal and the complementary image signal are digital signals and have one of the low potential, e.g. VSS=0 V, and the high potential, e.g. VDD=5 V.

An image signal supplied to the data line 43 in the first column of the N data lines 43 is indicated as Data 1 to specify the image signal in the first column; an image signal supplied to the data line 43 in the j-th column is indicated as Data j to specify the image signal in the j-th column (refer to FIG. 6); and an image signal supplied to the data line 43 in the N-th column is indicated as Data N to specify the image signal in the N-th column.

Likewise, a complementary image signal supplied to the complementary data line 45 in the first column of the N complementary data lines 45 is indicated as XData 1 to specify the complementary image signal in the first column; a complementary image signal supplied to the complementary data line 45 in the j-th column is indicated as XData j to specify the complementary image signal in the j-th column (refer to FIG. 6); and a complementary image signal supplied to the complementary data line 45 in the N-th column is indicated as XData N to specify the complementary image signal in the N-th column.

The enable lines 44 are electrically connected to the enable line drive circuit 54. The enable line drive circuit 54 outputs enable signals to the enable lines 44 which separately correspond to the respective rows. The enable signals are specific to the rows. The enable line 44 transmits the enable signal to the pixel circuit 41 in the corresponding row. The enable signals are potentials between a second low potential VSS2 and a second high potential VDD2. The enable signal includes an active signal, i.e. an enable signal in an active state, and an inactive signal, i.e. an enable signal in an inactive state. The enable line 44 is an active state when it receives the active signal from the enable line drive circuit 54.

As described later, when the third transistor 33 is N-type (refer to FIG. 8), the enable signal in the active state is the second high potential VDD2. On the other hand, the enable signal in the inactive state is the second low potential VSS2. In First Exemplary Embodiment, as an example, the second high potential VDD2 and the high potential VDD are equal (VDD2=VDD=5 V), and the second low potential VSS2 and the low potential VSS are equal (VSS2=VSS=0 V).

An enable signal supplied to the enable line 44 in the first row of the M enable lines 44 is indicated as Enb 1 to specify the enable signal in the first row; an enable signal supplied to the enable line 44 in the i-th row is indicated as Enb i to specify the enable signal in the i-th row (refer to FIG. 6); and an enable signal supplied to the enable line 44 in the M-th row is indicated as Enb M to specify the enable signal in the M-th row. The enable signal in active state may be supplied as row by row, or the enable signals in active state may be simultaneously supplied to a plurality of rows. In First Exemplary Embodiment, the active signals are simultaneously supplied to all the pixel circuits 41 arranged in the display region E.

The control unit 55 includes a display signal supply circuit 56 and a VRAM circuit 57. The display signal supply circuit supplies the display signal to the drive circuit 51. The VRAM circuit 57 stores a frame image and the like. The display signal supply circuit 56 generates the display signal from the frame image temporarily stored in the VRAM circuit 57 and supplies it to the drive circuit 51. The display signal includes an image signal, a clock signal, and the like.

The control unit 55 includes a semiconductor integrated circuit that is formed on a different substrate (not illustrated) from the element substrate 11. The semiconductor integrated circuit may be formed on a single-crystal semiconductor wafer. The substrate on which the control unit 55 is formed is connected to the external connection terminals 13 provided on the element substrate 11 by using a flexible printed circuit (FPC). Via the FPC, the display signal is supplied to the drive circuit 51 from the control unit 55.

Configuration of Pixel

A configuration of a pixel according to some exemplary embodiments will now be described with reference to FIG. 6. FIG. 6 illustrates a configuration of a pixel according to some exemplary embodiments.

As illustrated above, in the electro-optical device 10, the pixel 49 that includes the sub-pixel 48 (the sub-pixel 48B, the sub-pixel 48G, and the sub-pixel 48R) forms a display unit to display an image. In one exemplary embodiment, the length a of the sub-pixel 48 in the row direction (the X direction) is 4 micrometers (μm), and the length b of the sub-pixel 48 in the column direction (the Y direction) is 12 micrometers (μm). In other words, the pitch at which the sub-pixels 48 are arranged in the row direction (the X direction) is 4 μm, and the pitch at which the sub-pixels 48 are arranged in the column direction (the Y direction) is 12 μm.

Each sub-pixel 48 possesses the pixel circuit 41 that includes the light emitting element 20. The light emitting element 20 emits white light. The electro-optical device 10 includes the color filter (not illustrated), which transmits light emitted from the light emitting element 20. The color filter includes p kinds of color filters that correspond to p basic colors for display. In one exemplary embodiment, the number of basic colors is set as p=3, and color filters for colors B, G, and R, are arranged to correspond to the sub-pixel 48B, the sub-pixel 48G, and the sub-pixel 48R, respectively.

In one exemplary embodiment an organic electroluminescence (EL) element is used as an example of the light emitting element 20. The organic EL element may have an optical resonant structure that enhances the intensity of light with a specific wavelength. Specifically, the organic EL element may be configured such that a blue light is extracted from the white light emitted from the light emitting element 20 in the sub-pixel 48B; a green light is extracted from the white light emitted from the light emitting element 20 in the sub-pixel 48G; and a red light is extracted from the white light emitted from the light emitting element 20 in the sub-pixel 48R.

As another example other than the examples described above, the number of basic colors may be set as p=4 so that, in addition to the color filters for B, G, and R, a color filter for another color, for example, white color which substantially disposed no color filter, yellow, or cyan, may be prepared. As the light emitting element 20, a light emitting diode element using gallium nitride (GaN) and the like, or a semiconductor laser element may also be used.

Digital Driving in Electro-optical Device

Figure 7:
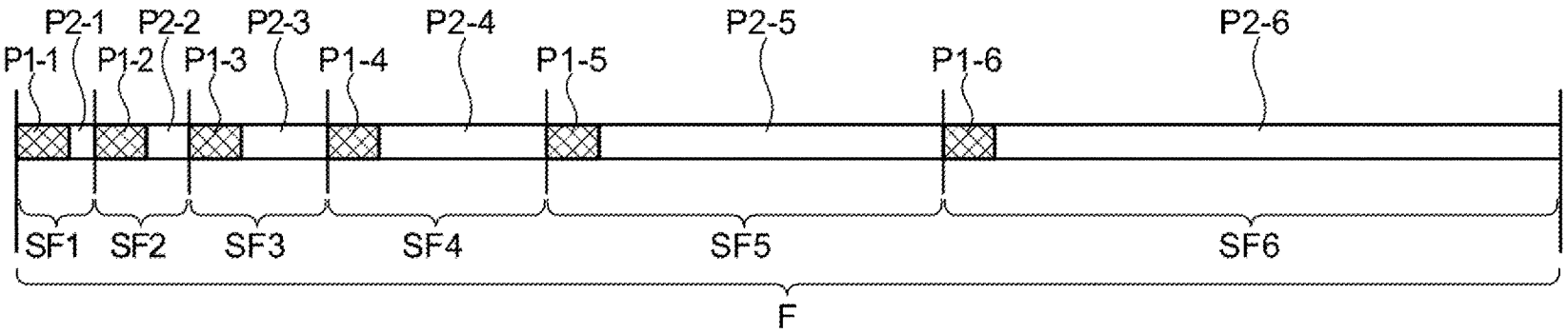
FIG. 7 illustrates digital driving in an electro-optical device according to some exemplary embodiments.

An image display method by digital driving in the electro-optical device 10 according to one exemplary embodiment will now be described with reference to FIG. 7. FIG. 7 illustrates digital driving in the electro-optical device according to one exemplary embodiment.

The electro-optical device 10 displays a predetermined image in the display region E (refer to FIG. 4) by digital driving method. Specifically, the light emitting element 20 (refer to FIG. 6) arranged in each sub-pixel 48 has a state of one of the binary values, namely emission of light (bright state) and non-emission of light (dark state), and the grey scale of an image to be displayed depends on the ratio of a light emission period of the light emitting element 20. This is referred to as time-division driving.

As illustrated in FIG. 7, in the time-division driving, a single field (F) during which a single image is displayed is divided into a plurality of sub-fields (SFs), and emission and non-emission of light of the light emitting element 20 is controlled for each sub-field (SF) so that the grey scale is represented. A 6-bit time-division grey scale system is described here as an example here. This system displays $2^6$=64 grey scales. In the 6-bit time-division grey scale system, the single field F is divided into six sub-fields, namely SF1 to SF6.

In FIG. 7, the i-th sub-field in the single field F is indicated by SFi and six sub-fields including the first sub-field SF1 to the sixth sub-field SF6 are illustrated. Each sub-field SF includes a display period P2 (P2-1 to P2-6) as a second period and, optionally, a non-display period P1 (P1-1 to P1-6) as a first period. The non-display period P1 is a signal write period.

In this specification, the sub-fields SF1 to SF6 may not be distinguished from one another and may be collectively referred to as a sub-field SF; the non-display periods P1-1 to P1-6 may not be distinguished from one another and may be collectively referred to as a non-display period P1; and the display periods P2-1 to P2-6 may not be distinguished from one another and may be collectively referred to as a display period P2.

The light emitting element 20 does or does not emit light during the display period P2 while it does not emit light during the non-display period P1. An image signal is introduced to a memory circuit 60 (refer to FIG. 8) during the non-display period P1. The non-display period P1 may adjust the ratio of a light emission period. In cases such as when the shortest sub-field (e.g., SF1) is long enough to introduce the image signals to all the sub-pixels 48, the non-display period P1 may be eliminated.

In the 6-bit time-division grey scale system, the display periods P2 (P2-1 to P2-6) in the respective sub-fields SF are set such that (P2-1 in SF1):(P2-2 in SF2):(P2-3 in SF3):(P2-4 in SF4):(P2-5 in SF5):(P2-6 in SF6)=1:2:4:8:16:32. Thus, for example, when an image is displayed in a progressive system with a frame frequency of 30 Hz, 1 frame=1 field (F)=33.3 milliseconds (msec).

In the case of the example described above, when the non-display period P1 (P1-1 to P1-6) in each sub-field SF is 1 millisecond, the display periods P2 are set such that (P2-1 in SF1)=0.434 millisecond, (P2-2 in SF2)=0.868 millisecond, (P2-3 in SF3)=1.735 milliseconds, (P2-4 in SF4)=3.471 milliseconds, (P2-5 in SF5)=6.942 milliseconds, and (P2-6 in SF6)=13.884 milliseconds.

Given that the duration of the non-display period P1 is represented as x (sec), the duration of the shortest display period P2, e.g. the display period P2-1 in the first sub-field SF1 in the example described above, is represented as y (sec), the number of bits of grey scale, i.e. the number of sub-fields SF, is represented as g, and the field frequency is represented as f (Hz), their relation is represented by Equation (1) below:

$$gx+(2^g-1)y=1/f \quad (1)$$

The digital driving in the electro-optical device 10 displays grey scale based on the ratio of sum of the light emission periods to the total display periods P2 in the single field F. For example, for black display corresponding to a grey scale "0", the light emitting element 20 is in the non-emission state during all of the display periods P2-1 to P2-6 in the six sub-fields SF1 to SF6. On the other hand, for white display corresponding to a grey scale "63", the light emitting element 20 is in the emission state during all of the display periods P2-1 to P2-6 in the six sub-fields SF1 to SF6.

To obtain display with an intermediate luminance corresponding to, for example, a grey scale "7" of the 64 tones, the light emitting element 20 is in the emission state during the display period P2-1 in the first sub-field SF1, the display period P2-2 in the second sub-field SF2, and the display period P2-3 in the third sub-field SF3, while the light emitting element 20 is in the non-emission state during the display periods P2-4 to P2-6 in the other sub-fields SF4 to SF6. In this way, the state of the light emitting element 20 may be selected to be the emission or the non-emission of light as appropriate for each of the sub-fields SF constituting the single field F so as to display an intermediate grey scale.

Analog-driven organic EL devices in prior art, which are electro-optical devices, display a grey scale analog-controlling the current flowing through the organic EL elements. The current depends on the gate potential of driving transistors. This causes variation in brightness as well as grey scale shift among pixels due to variation in the transfer characteristics and the threshold voltage of the driving transistor, thus resulting in a low display quality. In order to overcome this problem, when a compensation circuit is provided that compensates for the variation in the transfer characteristics and the threshold voltage of driving transistors as described in JP-A-2004-062199, an additional current must flow through the compensation circuit, thus increasing power consumption.

Furthermore, in order to achieve multiple grey scales display, organic EL devices in prior art require a capacitive element with large capacitance to store analog image signals. This requirement is incompatible with the requirements for high resolution, namely fine pixels, and has also resulted in a large power consumption due to charging and discharging of the capacitive element with large capacitance. In other words, it is difficult to achieve an electro-optical device that displays a high-quality image having a high resolution and multiple grey scales at a low power consumption by using any of organic EL devices in prior art.

Since the electro-optical device 10 according to one exemplary embodiment is digitally driven, using binary system of ON-state and OFF-state, the light emitting element 20 is in one of the binary states, namely emission of light and non-emission of light. Accordingly, the electro-optical device 10 is less susceptible to the variation in the transfer characteristics and the threshold voltage of each transistor as compared to those based on analog driving. As a result, the electro-optical device 10 according to one exemplary embodiment reduces variation in brightness and decreases shift in grey scale among the pixels 49 to display a high-quality image. Furthermore, since the digital driving method eliminates the requirement for a capacitive element with a large capacitance, which is required in analog driving method, it helps to achieve fine pixels 49 and a higher resolution and decreases the power consumption associated with charging and discharging of the large capacitive element.

Moreover, according to the digital driving method in the electro-optical device 10, the number of grey scale can be readily increased by increasing the number g of sub-fields SF in a field F. Even though the non-display periods P1 exist as described above, the number of grey scale is easily increased by shortening the shortest display period P2. For example, in order to display 256 grey scales with g=8 in a progressive system at a frame frequency of f=30 Hz, it is sufficient to simply set the duration of the shortest display period (P2-1 in SF1) to y=0.100 millisecond according to Equation 1, if the duration of the non-display period P1 is x=1 millisecond.

As described later, in the digital driving method in the electro-optical device 10, the non-display periods P1 as a first period can serve as a signal write period during which an image signal is written to the memory circuit 60 or a signal rewrite period during which an image signal is rewritten. Accordingly, 6-bit grey scale display can be easily converted to 8-bit grey scale display without changing the signal write period. This convert does not need to change the clock frequency of the drive circuit 51.

Furthermore, in the digital driving method in the electro-optical device 10, the image signal stored in the memory circuit 60 (refer to FIG. 8) will be rewritten between the sub-fields SF or between the field F, only if the memory circuit 60 is in the sub-pixel 48 that is to be changed. In other words, the image signal stored in the memory circuit 60 will not be rewritten and will be kept, if the memory circuit 60 is in the sub-pixel 48 that is not to be changed. As a result, the power consumption can be reduced. Thus, this configuration can achieve electro-optical device 10 that displays an image having a large number of grey scales and a high resolution as well as a less variation in brightness and a small shift in grey scale among the pixels 49 while reducing energy consumption.

Configuration of Pixel Circuit

Figure 8:
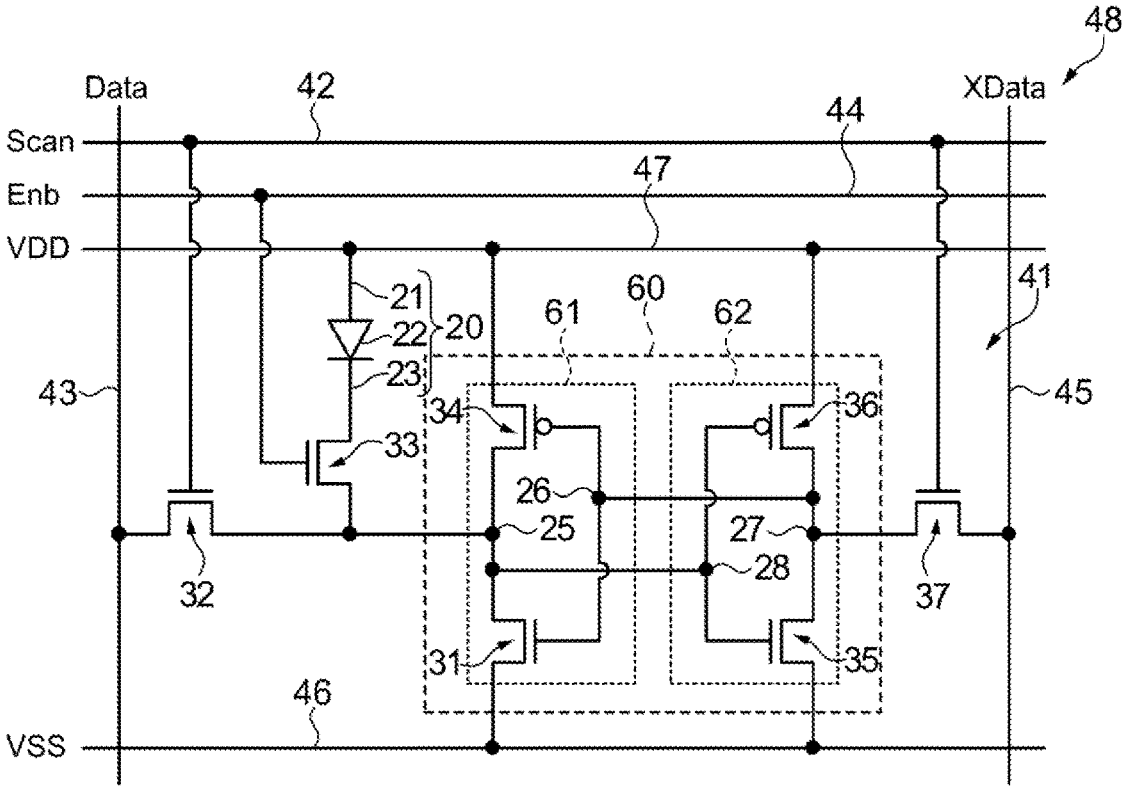
FIG. 8 illustrates a configuration of a pixel circuit according to Example 1.

A configuration of a pixel circuit according to First Exemplary Embodiment will now be described using a plurality of examples and modified examples. First, a configuration of a pixel circuit according to Example 1 of First Exemplary Embodiment is described with reference to FIG. 8. FIG. 8 illustrates a configuration of a pixel circuit according to Example 1.

EXAMPLE 1

As illustrated in FIG. 8, the pixel circuit 41 is provided for each of the sub-pixels 48 that are arranged to correspond to the respective intersections of the scan lines 42 and the data lines 43. The enable line 44 is arranged along the scan line 42 whereas the complementary data line 45 is arranged along the data line 43. The scan line 42, the data line 43, the enable line 44, and the complementary data line 45 correspond to each pixel circuit 41.

In one exemplary embodiment, the low potential line 46 is a first potential line, and the low potential VSS is supplied as a first potential from the low potential line 46 to the pixel circuit 41. The high potential line 47 is a second potential line, and the high potential VDD is supplied as a second potential from the high potential line 47 to the pixel circuit 41.

The pixel circuit 41 includes the light emitting element 20, the memory circuit 60 including a first transistor 31, a second transistor 32 arranged between the memory circuit 60 and the data line 43, a third transistor 33, and the complementary second transistor 37. The pixel circuit 41 includes the memory circuit 60, such that the electro-optical device 10 can digitally drive the circuits and can make it possible to reduce the variation in display among the pixels 49 (the sub-pixels 48), as compared to the case of analog driving.

In one embodiment, the light emitting element 20 is an organic EL element and includes an anode 21 that is a pixel electrode, a light emitting section 22 that is a light emitting functional layer, and a cathode 23 that is a counter electrode. The light emitting section 22 is configured to emit light when a positive hole injected from the anode 21 side and an electron injected from the cathode 23 side together form an exciton, which emits part of its energy as fluorescence or phosphorescence as it disappears (as the positive hole and the electron recombine).

The anode 21 of the light emitting element 20 is electrically connected to the high potential line 47 that serves as the second potential line while the cathode 23 of the light emitting element 20 is electrically connected to the drain of the third transistor 33. In other words, the light emitting element 20 is arranged on the high potential side with respect to the third transistor 33.

The memory circuit 60 includes a first inverter 61 and a second inverter 62. The memory circuit 60 is configured to include the two inverters 61 and 62 connected together in a circle to form a so-called static memory to store a digital signal, which is an image signal. An output terminal 25 of the first inverter 61 is electrically connected to an input terminal 28 of the second inverter 62, and an output terminal 27 of the second inverter 62 is electrically connected to an input terminal 26 of the first inverter 61.

In this specification, the state where a terminal A and a terminal B are electrically connected to each other means a state where the logic of the terminal A and the logic of the terminal B can be equal. For example, even when a transistor, a resistor, a diode, and the like are arranged between the terminal A and the terminal B, the terminals will be regarded as a state of electrically connecting, if the logic of terminal A is the same as the logic of terminal B.

A digital signal stored in the memory circuit 60 has one of the binary potentials of High and Low. In one exemplary embodiment, when the output terminal 25 of the first inverter 61 is Low (when the output terminal 27 of the second inverter 62 is High), the light emitting element 20 is brought into a state that allows emission of light, whereas when the output terminal 25 of the first inverter 61 is High (when the output terminal 27 of the second inverter 62 is Low), the light emitting element 20 is brought into a state of non-emission of light.

In one exemplary embodiment, the two inverters 61 and 62 which constitute the memory circuit 60 are arranged between the low potential line 46 that serves as the first potential line and the high potential line 47 that serves as the second potential line, and the high potential VDD and the low potential VSS are supplied to the two inverters 61 and 62. Accordingly, High corresponds to the high potential VDD that serves as the second potential, and Low corresponds to the low potential VSS that serves as the first potential.

When a digital signal is introduced in the memory circuit 60 and the output terminal 25 of the first inverter 61 is brought into Low, for example, Low is input to the input terminal 28 of the second inverter 62 to turn the output terminal 27 of the second inverter 62 to High. Then, High is input to the input terminal 26 of the first inverter 61 to turn the output terminal 25 of the first inverter 61 to Low. In this way, the digital signal introduced in the memory circuit 60 is maintained in a stable state until it is rewritten next time.

The first inverter 61 includes the N-type first transistor 31 and a P-type fourth transistor 34. These two transistors constitute CMOS configuration. The first transistor 31 and the fourth transistor 34 are arranged in series between the low potential line 46 and the high potential line 47. The source of the first transistor 31 is electrically connected to the low potential line 46 that serves as the first potential line. The source of the fourth transistor 34 is electrically connected to the high potential line 47 that serves as the second potential line.

The first transistor 31 is a component of the memory circuit 60, i.e. a component of the first inverter 61, and is also a driving transistor for the light emitting element 20. Thus, once the first transistor 31 is turned in an ON-state, the light emitting element 20 is allowed to emit light.

The second inverter 62 includes an N-type fifth transistor 35 and a P-type sixth transistor 36. These two transistors constitute CMOS configuration. The fifth transistor 35 and the sixth transistor 36 are arranged in series between the low potential line 46 and the high potential line 47. The source of the fifth transistor 35 is electrically connected to the low potential line 46 that serves as the first potential line. The source of the sixth transistor 36 is electrically connected to the high potential line 47 that serves as the second potential line.

The drain of the first transistor 31 and the drain of the fourth transistor 34 form the output terminal 25 of the first inverter 61. The drains of the fifth transistor 35 and the sixth transistor 36 form the output terminal 27 of the second inverter 62. The input terminal 26 of the first inverter 61 is formed by the gates of the first transistor 31 and the fourth transistor 34. The input terminal 26 is electrically connected to the output terminal 27 of the second inverter 62. Likewise, the input terminal 28 of the second inverter 62 is formed by the gates of the fifth transistor 35 and the sixth transistor 36. The input terminal 28 of the second inverter 62 is electrically connected to the output terminal 25 of the first inverter 61.

In one exemplary embodiment, the first inverter 61 and the second inverter 62 each constitute CMOS configuration. However, the inverters 61 and 62 may be configured to include transistors and resistors. For example, the first inverter 61 may be configured to include the first transistor 31 and a resistor in place of the fourth transistor 34. In the second inverter 62, one of the fifth transistor 35 and the sixth transistor 36 may be replaced with a resistor.

The second transistor 32 is an N-type transistor. The second transistor 32 is arranged between the output terminal 25 of the memory circuit 60 (the output terminal 25 of the first inverter 61) and the data line 43. One of the source and the drain of the second transistor 32 is electrically connected to the data line 43, while the other is electrically connected to the output terminal 25 of the memory circuit 60 (the first inverter 61), that is, the drain of the first transistor 31. The gate of the second transistor 32 is electrically connected to the scan line 42.

The third transistor 33 is an N-type transistor. The third transistor 33 is arranged in series with the light emitting element 20 between the output terminal 25 of the first inverter 61, that is, the drain of the first transistor 31, and the high potential line 47 that serves as the second potential line. The third transistor 33 is arranged on the lower potential side than is the light emitting element 20. In other words, the third transistor 33 is located nearer to the output terminal 25 than is the light emitting element 20.

The drain of the third transistor 33 is electrically connected to the cathode 23 of the light emitting element 20. The source of the third transistor 33 is electrically connected to the output terminal 25 of the memory circuit 60 (the first inverter 61), that is, the drain of the first transistor 31. The gate of the third transistor 33 is electrically connected to the enable line 44. The third transistor 33 is a control transistor for the memory circuit 60 and the light emitting element 20.

Note that for an N-type transistor, the source is defined so that the source potential is lower than the drain potential. Typically, an N-type transistor is arranged on the lower potential side than is the light emitting element 20. On the other hand, note that for a P-type transistor, the source is defined so that the source potential is higher than the drain potential. Typically, a P-type transistor is arranged on the higher potential side than is the light emitting element 20. This arrangement makes each transistor operate substantially in linear region. Hereinafter, operating a transistor in linear region simply refers to as linear operation.

In one exemplary embodiment, the first transistor 31, the second transistor 32, and the third transistor 33 are each an N-type. Accordingly, the arrangement of the first transistor 31 and the third transistor 33 on the lower potential side than the light emitting element 20 enables the first transistor 31 and the third transistor 33 of linear operation. As a result, the variation in the threshold voltage of the transistors 31 and 33 will not affect the display characteristics.

The complementary second transistor 37 is an N-type transistor. The complementary second transistor 37 is arranged between the output terminal 27 of the memory circuit 60 (the second inverter 62) and the complementary data line 45. One of the source and the drain of the complementary second transistor 37 is electrically connected to the complementary data line 45, while the other is electrically connected to the output terminal 27 of the memory circuit 60 (the second inverter 62). The gate of the complementary second transistor 37 is electrically connected to the enable line 44.

The electro-optical device 10 according to one exemplary embodiment includes a plurality of complementary data lines 45 in the display region E (refer to FIG. 5). One data line 43 and one complementary data line 45 correspond to one pixel circuit 41. Signals that are complementary to each other are supplied to a pair of the data line 43 and its complementary data line 45, both of which corresponds to a pixel circuit 41. In other words, a signal with an inverted polarity relative to the signal supplied to the data line 43 is supplied to the corresponding complementary data line 45. Hereinafter, the signal with an inverted polarity referred to as an inverted signal. When High is supplied to the data line 43, for example, Low is supplied to its paired complementary data line 45. When Low is supplied to the data line 43, High is supplied to its paired complementary data line 45.

The gate of the second transistor 32 and the gate of the complementary second transistor 37 are electrically connected to the scan line 42. The second transistor 32 and the complementary second transistor 37 are simultaneously switchable between an ON-state and an OFF-state depending on the scan signal supplied to the scan line 42. The scan signal includes the selection signal and the non-selection signal. Each of the second transistor 32 and the complementary second transistor 37 is a selecting transistor for the pixel circuit 41.

When the selection signal is supplied to the scan line 42, the second transistor 32 and the complementary second transistor 37 are selected and both turned into the ON-state. As a result, the data line 43 and the output terminal 25 of the first inverter 61 of the memory circuit 60 are brought into electrical communications, and at the same time, the complementary data line 45 and the output terminal 27 of the second inverter 62 of the memory circuit 60 are brought into electrical communications. Thus, an image signal is written to the input terminal 28 of the second inverter 62 from the data line 43 via the second transistor 32, and an inverted signal relative to the image signal is written to the input terminal 26 of the first inverter 61 from the complementary data line 45 via the complementary second transistor 37 and stored therein.

The digital image signal stored in the memory circuit 60 is maintained in a stable state until the second transistor 32 and the complementary second transistor 37 are next selected and brought into the ON-state, and subsequently the image signal and the inverted signal relative to the image signal are newly written from the data line 43 and the complementary data line 45, respectively.

For the memory circuit 60 to be rewritten quickly and reliably it is required that the ON-resistance of the second transistor 32 is lower than the ON-resistance of the first transistor 31 and the ON-resistance of the fourth transistor 34. In order to meet this requirement the polarity, dimensions (gate length, gate width, and the like), driving conditions (potential of the selection signal), and the like, of the first, second, and fourth transistors 31, 32, and 34 are designed. Likewise, the polarity, dimensions, driving conditions, and the like of the fifth, sixth, and complementary second transistors 35, 36, and 37 are designed so that the ON-resistance of the complementary second transistor 37 is lower than the ON-resistance of the fifth transistor 35 and the ON-resistance of the sixth transistor 36. This allows the signal stored in the memory circuit 60 to be rewritten quickly and reliably.

The electro-optical device 10 according to one exemplary embodiment also includes a plurality of enable lines 44 in the display region E. The gate of the third transistor 33 is electrically connected to the enable line 44. The third transistor 33 is switchable between an ON-state and an OFF-state depending on the enable signal which is the active signal or the inactive signal and which is supplied to the enable line 44.

When the active signal is supplied to the enable line 44, the third transistor 33 is turned into the ON-state. While the third transistor 33 is in the ON-state, the light emitting element 20 is allowed to emit light. On the other hand, when the inactive signal is supplied to the enable line 44, the third transistor 33 is turned into the OFF-state. While the third transistor 33 is in the OFF-state, the memory circuit 60 is allowed to rewrite the stored image signal without false operation. This is described below.

In one exemplary embodiment, since the enable line 44 and the scan line 42 are independent from each other for each pixel circuit 41, the second transistor 32 and the third transistor 33 can operate independently from each other. As a result, the third transistor 33 can be always in the OFF-state when the second transistor 32 is turned into the ON-state.

For an image signal being written to the memory circuit 60, after the third transistor 33 is turned into the OFF-state, the second transistor 32 and the complementary second transistor 37 are then turned into the ON-state to supply the image signal and the inverted signal relative to the image signal to the memory circuit 60. While the second transistor 32 is in the ON-state, the third transistor 33 is in the OFF-state. As a result the light emitting element 20 does not emit light while the image signal is being written to the memory circuit 60. Consequently, the image signal can be reliably rewritten in the memory circuit 60.

Subsequently to cause the light emitting element 20 to emit light, after the second transistor 32 and the complementary second transistor 37 are turned into the OFF-state, the third transistor 33 is then turned into the ON-state. At this time, the electrical conductive path that leads from the high potential line 47 (VDD) to the low potential line 46 (VSS) through the light emitting element 20, the third transistor 33, and the first transistor 31 is formed and allows a current to flow through the light emitting element 20.

The image signal and the inverted signal relative to the image signal are not supplied to the memory circuit 60 while the light emitting element 20 are emitting light. This is because the second transistor 32 and the complementary second transistor 37 are in the OFF-state during the third transistor 33 being in the ON-state. This ensures that the image signal stored in the memory circuit 60 is not erroneously rewritten. As a result, a high-quality image without any display errors can be achieved.

Even using the digital driving method, if the third transistor 33 is not provided, or if the third transistor 33 is in the ON-state when the image signal stored in the memory circuit 60 is rewritten, the possibility of wrong operation due to a failure in rewriting the image signal in the memory circuit 60 and the resultant high power consumption will be increased. Even when the image signal in the memory circuit 60 is rewritten correctly, it may take an undesirably long time to rewrite the image signal. This is described below.

To understand the problem described above, we consider an example of imaginary circuit in which the pixel circuit 41 illustrated in FIG. 8 does not possess the third transistor 33. Since the third transistor 33 does not exist in the imaginary circuit, the cathode 23 of the light emitting element 20 is electrically connected to the output terminal 25 of the first inverter 61. This imaginary circuit is then simulated with the assumption that High=VDD=5 V, Low=VSS=0 V, the logic inversion voltage for the inverters 61, 62 is 2.5 V, and the threshold voltage for emission of the light emitting element 20 is 2 V. Under this condition we consider a situation where the output terminal 25 of the first inverter 61 is to be rewritten from high (5 V) to Low (0 V).

To rewrite the output terminal 25 of the first inverter 61 of the memory circuit 60 in the imaginary circuit to Low, the data line 43 is electrically connected to the low potential line 46 (VSS) via a transistor (not illustrated). In this state, when the second transistor 32 is turned into the ON-state, the potential at the output terminal 25 starts decreasing from 5 V (High). When the potential at the output terminal 25 is reduced down to 3 V, the potential difference between the anode 21 and the cathode 23 of the light emitting element 20 becomes the threshold voltage 2 V or higher. Consequently, a current begins to flow through the light emitting element 20 to cause the light emitting element 20 to start emitting light in the imaginary circuit.

This means the electrical conductive path that leads from the high potential line 47 (VDD) to the low potential line 46 (VSS) through the light emitting element 20, the second transistor 32, and the data line 43, is formed in the imaginary circuit. As a result, a potential drop at the output terminal 25 is inhibited. For this reason, in the imaginary circuit not only will it take a considerable amount of time to rewrite the image signal in the memory circuit 60, but the current consumption will also increase.

In a worst scenario, a selection period ends and the second transistor 32 is turned into the OFF-state before the potential at the output terminal 25 become lower than the logic inversion voltage (2.5 V) of the first inverter 61 in the imaginary circuit. In this state, rewriting from High to Low at the output terminal 25 has failed. As a result, a correct image signal is not written to the memory circuit 60 in the imaginary circuit, leading to erroneous display or low quality image display.

In contrast, in one exemplary embodiment, when the second transistor 32 is turned into the ON-state to rewrite the image signal in the memory circuit 60, the third transistor 33 is in the OFF-state to disconnect the electric path between the high potential line 47 and the output terminal 25 of the memory circuit 60 (the first inverter 61) through the light emitting element 20. As a result, the problems described above are avoided and the memory circuit 60 is reliably rewritten in a short time with a low power consumption. Therefore, a high-quality image without any display errors can be achieved.

Furthermore, while the image signal in the memory circuit 60 is rewritten, the third transistor 33 is in the OFF-state to prevent the light emitting element 20 from emitting light, that is, the light emitting element 20 is in a non-emission state. After the second transistor 32 is turned into the OFF-state, the third transistor 33 is turned into the ON-state to allow the light emitting element 20 to be in an emission state or a non-emission state depending on the image signal. Accordingly, the problem that the potential change during the period for rewriting the memory circuit 60 affects the light emitting element 20 can be prevented. Therefore, non-emission of light and emission of light of the light emitting element 20 is precisely controlled in a time-division manner, and thus accurate grey scale is displayed by the time-division digital driving method.

Characteristics of Transistor

In the electro-optical device 10 according to one exemplary embodiment, it is preferable that the ON-resistance of the third transistor 33 is sufficiently lower than the ON-resistance of the light emitting element 20. The sufficiently lower ON-resistance of the third transistor 33 means a driving condition that allows linear operation of the third transistor 33. Specifically, the ON-resistance of the third transistor 33 is one hundredth or less, and preferably, one thousandth or less of the ON-resistance of the light emitting element 20. Such characteristics enable the third transistor 33 to linear operation when the light emitting element 20 emits light.

It is also preferable that the ON-resistance of the first transistor 31 is lower than or equal to the ON-resistance of the third transistor 33. If the ON-resistance of the third transistor 33 is sufficiently lower than the ON-resistance of the light emitting element 20, and if the ON-resistance of the first transistor 31 is lower than or equal to the ON-resistance of the third transistor 33, the ON-resistance of the first transistor 31 will be also sufficiently lower than the ON-resistance of the light emitting element 20.

Thus, with the ON-resistance of the first transistor 31 and the ON-resistance of the third transistor 33 being sufficiently lower than the ON-resistance of the light emitting element 20, both the first transistor 31 and the third transistor 33 operate linearly when the light emitting element 20 is brought into an ON-state to emit light. Accordingly, most of the potential difference occurring along the path from the high potential line 47 (VDD) to the low potential line 46 (VSS) across the light emitting element 20, the third transistor 33, and the first transistor 31 is applied to the light emitting element 20. In other words, the potential difference between the first potential and the second potential, namely most of the power-supply voltage, is applied to the light emitting element 20. As a result, the light emitting element 20, when emitting light, is less susceptible to the variation in the threshold voltage and the like of the first transistor 31 and the third transistor 33.

If the ON-resistance of the third transistor 33 is lower than or equal to one hundredth of the ON-resistance of the light emitting element 20, the ON-resistance of the first transistor 31 will be also lower than or equal to one hundredth of the ON-resistance of the light emitting element 20. In this case, nearly 99% or greater of the power-supply voltage is applied to the light emitting element 20, such that the potential drop in the first transistor 31 and the third transistor 33 is about 1% or less of the total power-supply voltage. Thus, variation in the threshold voltage of both the transistors 31 and 33 on the characteristics of light emission of the light emitting element 20 tend to only have slight effect. As a result an image with a very small variation in brightness and a slight shift in grey scale among the pixels 49 is displayed.

Furthermore, it is preferable that the ON-resistance of the first transistor 31 is lower than or equal to half the ON-resistance of the third transistor 33. In this case, the ON-resistance of the first transistor 31 is lower than or equal to one two-hundredth of the ON-resistance of the light emitting element 20.

When the ON-resistance of the third transistor 33 is lower than or equal to one thousandth of the ON-resistance of the light emitting element 20, the ON-resistance of the first transistor 31 is also lower than or equal to one thousandth of the ON-resistance of the light emitting element 20. When the ON-resistance of the first transistor 31 is lower than or equal to half the ON-resistance of the third transistor 33, the ON-resistance of the first transistor 31 is lower than or equal to one two-thousandth of the ON-resistance of the light emitting element 20. As a result, the series resistance of both the transistors 31 and 33 is lower than or equal to about one thousandth of the ON-resistance of the light emitting element 20.

In this case, about 99.9% or greater of the power-supply voltage is applied to the light emitting element 20, such that the potential drop in both the transistors 31 and 33 is about 0.1% or less. Thus, effects of variation in the threshold voltage of both the transistors 31 and 33 on the characteristics of light emission of the light emitting element 20 are almost negligible. As a result, a high-quality image display can be achieved in which the variation in brightness and the grey scale shift among the pixels 49 are further decreased.

The ON-resistance of a transistor depends on the polarity, gate length, gate width, threshold voltage, thickness of the gate-insulating film, and the like of the transistor. In one exemplary embodiment, the polarity, gate length, gate width, threshold voltage, thickness of the gate-insulating film, and the like of each transistor are determined to satisfy the conditions described above. This is described below.

In one exemplary embodiment, an organic EL element is used as the light emitting element 20, and the transistors that include the first transistor 31 and the third transistor 33 are formed on the element substrate 11, which is a single-crystal silicon wafer. The current-voltage characteristics of the light emitting element 20 are represented approximately by Equation (2):

$$I_{EL} = L_{EL} W_{EL} J_0 \left\{ \exp\left( \frac{V_{EL} - V_0}{V_{tm}} \right) - 1 \right\} \quad (2)$$

In Equation (2), $I_{EL}$ is a current flowing through the light emitting element 20, $V_{EL}$ is a voltage applied to the light emitting element 20, $L_{EL}$ is the length of the light emitting element 20, $W_{EL}$ is the width of the light emitting element 20, $J_0$ is the current density coefficient of the light emitting element 20, $V_{tm}$ is the coefficient voltage of the light emitting element 20 having a temperature dependence, and $V_0$ is a threshold voltage for emission of light of the light emitting element 20. $V_{tm}$ is a constant voltage under a constant temperature.

Using the power-supply voltage $V_P$ and the potential drop $V_{ds}$ occurring in both the first transistor 31 and the third transistor 33, the following voltage relation holds: $V_{EL}+V_{ds}=V_P$. In one exemplary embodiment, the followings were provided: $L_{EL}$=11 micrometers (μm), $W_{EL}$=3 micrometers (μm), $J_0$=1.449 milliamperes per square centimeter (mA/cm$^2$), $V_0$=2.0 volts (V), and $V_{tm}$=0.541 volt (V).

Provided that the power-supply voltage $V_P$ is 5 V and the first transistor 31 and the third transistor 33 operate linearly, the current-voltage characteristics of the light emitting element 20 at $V_{ds}$ being in the vicinity of 0 V is approximated by Equation (3):

$$I_{EL}=k(V_{EL}-V_1)=-kV_{ds}+k(V_P-V_1)\equiv-kV_{ds}+I_0 \quad (3)$$

In the case of one exemplary embodiment, the coefficient k defined by Equation (3) is such that: $k=2.26\times10^{-7}$ ($\Omega^{-1}$). $I_0$ is the amount of current when all of the power-supply voltage $V_P$ applies to the light emitting element 20, and $I_0=1.2216\times10^{-7}$ (A). In Equation (3), $V_1$ is a coefficient obtained by linear approximation of the current-voltage characteristics of the light emitting element 20.

A drain current $I_{ds}$ of the first transistor 31 and the third transistor 33 is represented by Equation (4):

$$I_{ds} = \frac{W}{L_2 + L_2} \cdot \frac{s_o s_{ox}}{t_{ox}} \cdot \mu(V_{gs} - V_{th})V_{ds} \equiv Z(V_{gs} - V_{th})V_{ds} \quad (4)$$

In Equation (4), the first transistor 31 and the third transistor 33 are the same conductive type and are combined to a single transistor with the same gate width and the same gate-insulating film. In Equation (4), W is the gate width of the transistors 31 and 33, $L_1$ and $L_3$ are the gate length of the first transistor 31 and the gate length of the third transistor 33, respectively, $\varepsilon_0$ is the permittivity in vacuum, $\varepsilon_{ox}$ is the dielectric constant of the gate-insulating film, $t_{ox}$ is the thickness of the gate insulating film, μ is the mobility of both the transistors 31 and 33, $V_{gs}$ is a gate voltage, $V_{ds}$ is a drain voltage that corresponds to the potential drop in both the transistors 31 and 33, and $V_{th}$ is the threshold voltage of both the transistors 31 and 33.

In one exemplary embodiment, W=0.5 micrometer (μm), $L_1$=0.5 micrometer (μm), $L_3$=1.0 micrometer (μm), $t_{ox}$=20 nanometers (nm), μ=240 square centimeters per voltage per second (cm$^2$/Vs), $V_{th}$=0.36 V, and $V_{gs}=5\text{ V}-V_{ds}/6$. $V_{gs}$ is a difference between the gate potential (VDD=5V) and the source potential. The potential drop in the first transistor 31 is about one third of the potential drop $V_{ds}$ in both the transistors 31 and 33, so that the source potential is set to an average of the source potential of the first transistor 31 of 0 V and the source potential of the third transistor 33 of $V_{ds}/3$.

Under such conditions, a voltage for causing the light emitting element 20 to emit light is a voltage that satisfies $I_{EL}=I_{ds}$ using Equation (2) and Equation (4). In one exemplary embodiment, the followings were provided: $V_P$=5 V, $V_{ds}$=0.0019 V, $V_{EL}$=4.9981 V, and $I_{EL}=I_{ds}=1.2173\times10^{-7}$ A. The ON-resistance of the combined transistor was $1.56\times10^4\Omega$ and the ON-resistance of the light emitting element 20 was $4.11\times10^7\Omega$.

Of the ON-resistance of the combined transistor, the ON-resistance of the third transistor 33 is about $1.04\times10^4\Omega$ and the ON-resistance of the first transistor 31 is $0.52\times10^4\Omega$. Accordingly, the ON-resistance of the third transistor 33 is about one two-thousandth of the light emitting element 20. This value is smaller than one thousandth of the ON-resistance of the light emitting element 20. Thus most of the power-supply voltage $V_P$ is applied to the light emitting element 20. Under such conditions, even when the threshold voltage of both the transistors 31 and 33 varies by 33% (even when the threshold voltage of both the transistors 31 and 33 varies between 0.24 V and 0.47 V), the following parameters remain unchanged: $V_{ds}$=0.0019 V, $V_{EL}$=4.9981 V, and $I_{EL}=I_{ds}=1.2173\times10^{-7}$ A. In that example, even when the threshold voltage of both the transistors 31 and 33 varies between 0.24 V and 0.47 V, $V_{ds}$, $V_{EL}$, and $I_{EL}=I_{ds}$ are unchanged.

Normally the threshold voltage of the transistor does not vary as significantly as above. Therefore, by setting the ON-resistance of the third transistor 33 to be lower than or equal to about one thousandth of the ON-resistance of the light emitting element 20, the effects of the variation in the threshold voltage of the first transistor 31 and the third transistor 33 on the luminous intensity emitted from the light emitting element 20 is substantially eliminated.

By simultaneously solving Equation (3) and Equation (4) with $I_{EL}=I_{ds}$, the effects of variation in the threshold voltage of the first transistor 31 and the third transistor 33 on the current $I_{EL}=I_{ds}$ can be approximated by Equation (5):

$$\left(1 + \frac{k}{Z(V_{gs} - V_{th})}\right) I_{EL} - I_0 \quad (5)$$

Since $I_0$ is the amount of current when all of the power-supply voltage $V_P$ is applied to the light emitting element 20, Equation (5) indicates that the large value of Z defined by Equation (4) causes the light emitting element 20 to emit light at around the power-supply voltage $V_P$. In other words, the larger the value of Z, the less the intensity of light emitted from the light emitting element 20 is affected by variation in the threshold voltage of the transistor.

In the case of one exemplary embodiment, since k/Z is as small as $k/Z=1.636\times10^{-2}$ V, the second term on the left side of Equation (5) becomes $k/(Z(V_{gs}-V_{th}))=3.53\times10^{-3}$, which is less than 0.01 (1%). As a result, the current, which is proportional to the luminous intensity, flowing through the light emitting element 20 during its emission state is not affected by the variation in the threshold voltage of both the transistors 31 and 33. Therefore, setting a value of $k/(Z(V_{gs}-V_{th}))$ to less than 0.01 (1%) makes the luminance of the light emitting element 20 independent from the variation in the threshold voltage of both the transistors 31 and 33.

In one exemplary embodiment, the ON-resistance of the first transistor 31 is lower than or equal to the ON-resistance of the third transistor 33. As described above, it is preferable that the ON-resistance of the first transistor 31 is lower than or equal to half the ON-resistance of the third transistor 33.

The polarities and dimensions (gate lengths, gate widths and the like) of the first transistor 31 and the third transistor 33, driving conditions such as the potential of the enable signal in the active state, and the like are designed to satisfy the condition that the ON-resistance of the first transistor 31 is lower than or equal to half the ON-resistance of the third transistor 33.

Setting the ON-resistance of the first transistor 31 to be lower than or equal to the ON-resistance of the third transistor 33 means that the electrical conductance of the first transistor 31 is higher than the electrical conductance of the third transistor 33. Furthermore, setting the ON-resistance of the first transistor 31 to be lower than or equal to half the ON-resistance of the third transistor 33 means that the electrical conductance of the first transistor 31 is two times or higher the electrical conductance of the third transistor 33. These configurations reduce the risk that the image signal stored in the memory circuit 60 is erroneously rewritten when the light emitting element 20 emits light. This is described below.

We consider a situation where the third transistor 33 is switched from the OFF-state to the ON-state to cause the light emitting element 20 to start emitting light while the potential of the output terminal 25 of the memory circuit (the first inverter 61) is Low. Under this situation, if the ON-resistance of the first transistor 31 is higher than the ON-resistance of the third transistor 33 and if the ON-resistance of the light emitting element 20 is relatively low, there will be a risk that the potential of the output terminal 25, i.e. the drain potential of the first transistor 31, increases and exceeds the logic inversion voltage of the first inverter 61.

In contrast, in one exemplary embodiment, since the ON-resistance of the first transistor 31 is lower than or equal to the ON-resistance of the third transistor 33, even when the ON-resistance of the light emitting element 20 is as low as zero, the potential of the output terminal 25 will not increase up to half the power-supply potential and will not exceed the logic inversion potential of the first inverter 61. This is because the logic inversion potential of a typical inverter is approximately equal to half the power-supply potential. As described in one exemplary embodiment, setting the ON-resistance of the first transistor 31 to be lower than or equal to the ON-resistance of the third transistor 33 substantially eliminate the risk that the image signal stored in the memory circuit 60 is rewritten when the light emitting element 20 emits light.

If the ON-resistance of the first transistor 31 is higher than the ON-resistance of the third transistor 33, the potential at the output terminal 25 will increase from Low, which is close to VSS. Since the source of the third transistor 33 is electrically connected to the output terminal 25, the potential at the output terminal 25 is the source potential of the third transistor 33. Accordingly, when the potential at the output terminal 25 increases from Low, the voltage between the gate and the source of the third transistor 33 will decrease and the ON-resistance of the third transistor 33 will increase. As a result, a risk that the third transistor 33 does not operate linearly appears. In other words, the variation in the threshold voltage of the third transistor 33 may lead to variation in the luminous intensity at the light emitting element 20.

In contrast, as described in one exemplary embodiment, when the ON-resistance of the first transistor 31 is lower than the ON-resistance of the third transistor 33, linear operation of the third transistor 33 necessarily causes the first transistor 31 to be linearly operated. Thus, the effects of the variation in the threshold voltage of the third transistor 33 on the luminance of the light emitting element 20 are eliminated as described above. Therefore, with the configuration of the pixel circuit 41 according to one exemplary embodiment, an electro-optical device 10 that can display a high-quality image without any display errors is achieved.

Driving Method of Pixel Circuit

Figure 9:
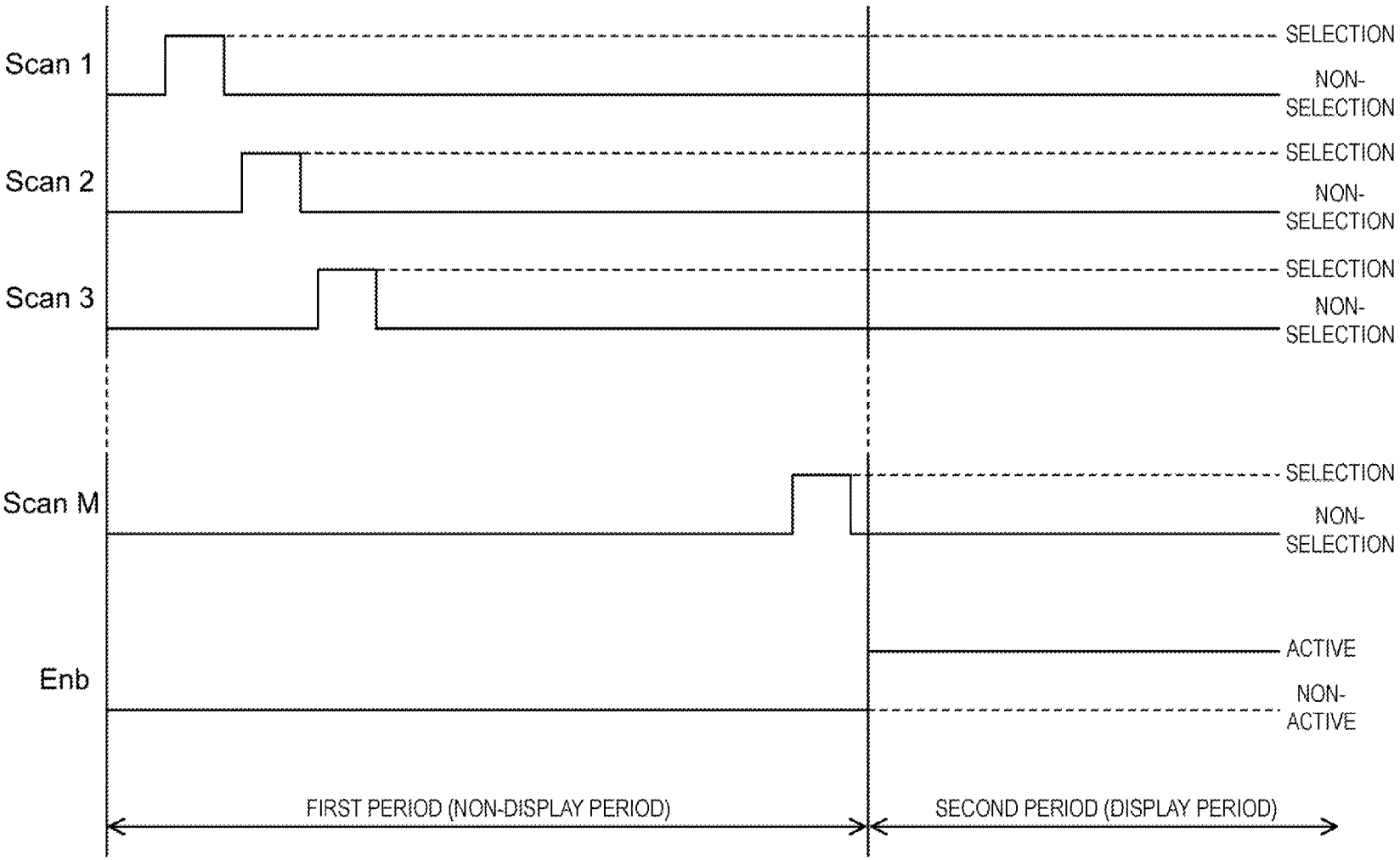
FIG. 9 illustrates a driving method of a pixel circuit according to one exemplary embodiment.

A driving method of the pixel circuit in the electro-optical device 10 according to one exemplary embodiment will now be described with reference to FIG. 9. FIG. 9 illustrates a driving method of the pixel circuit according to one exemplary embodiment. In FIG. 9, the horizontal axis is the time axis and includes a first period (non-display period) and a second period (display period). The first period corresponds to P1 (P1-1 to P1-6) illustrated in FIG. 7. The second period corresponds to P2 (P2-1 to P2-6) illustrated in FIG. 7.

In the vertical axis in FIG. 9, Scan 1 to Scan M represent the scan signals supplied to the scan lines 42 in the first row to the M-th row of the M scan lines 42 (refer to FIG. 5), respectively. The scan signal includes a scan signal in the selection-state (the selection signal) and a scan signal in the non-selection-state (the non-selection signal). Enb represents the enable signal supplied to the enable line 44 (refer to FIG. 5). The enable signal includes an enable signal in the active state (the active signal) and an enable signal in the inactive state (the inactive signal).

As described with reference to FIG. 7, the single field (F) during which a single image is displayed is divided into the plurality of sub-fields (SF), and each sub-field (SF) includes the first period (the non-display period) and the second period (the display period) that starts immediately after the end of the first period. The first period (the non-display period) is a signal write period, during which an image signal is written to the memory circuit 60 (refer to FIG. 8) in each pixel circuit 41 (refer to FIG. 5) arranged in the display region E. The second period (the display period) is a period during which that the light emitting element 20 (refer to FIG. 8) can emit light in each pixel circuit 41 arranged in the display region E.

As illustrated in FIG. 9, in the electro-optical device 10 according to one exemplary embodiment, the inactive signal is supplied to all of the enable lines 44 during the first period (the non-display period). While the inactive signal is supplied to the enable line 44, the third transistor 33 (refer to FIG. 8) is in the OFF-state, and thus the light emitting elements 20 are in a state of non-emission of light in all of the pixel circuits 41 arranged in the display region E.

In the first period in each sub-field (SF), the selection signal is supplied to one of the scan lines 42. When the selection signal is supplied to the scan line 42, the second transistor 32 and the complementary second transistor 37 (refer to FIG. 8) in a selected pixel circuit 41 are turned into the ON-state. Thus, in the selected pixel circuit 41, an image signal is written to the memory circuit 60 from the data line 43 and the complementary data line 45 (refer to FIG. 8). In this way, the image signal is written to and stored in the memory circuit 60 in each pixel circuit 41 during the first period.

In the second period (the display period), the active signal is supplied to all of the enable lines 44. When the active signal is supplied to each enable line 44, the third transistor 33 is turned into the ON-state, thus allowing each light emitting element 20 in all of the pixel circuits 41 arranged in the display region E to emit light. During the second period, the non-selection signal that makes each second transistor 32 be in the OFF-state is supplied to all of the scan lines 42. Thus, the image signal written in the first period is maintained in the memory circuit 60 in each pixel circuit 41 in this sub-field (SF).

In this way, in one exemplary embodiment, the first period (the non-display period) and the second period (the display period) is separately controlled, thus making it possible to display grey scales in a digital time-division driving manner. In addition, the second period can be set to be shorter than the first period, and thus an image with a larger number of grey scales can be displayed.

Furthermore, the enable signal supplied to the enable lines 44 is shared among the plurality of pixel circuits 41, such that driving the electro-optical device 10 can be facilitated. In a case of digital driving without the first period, highly complicated driving is required to make the light emission period shorter than one vertical period within which selection of each of the plurality of scan lines 42 is completed. In contrast, in one exemplary embodiment, the enable signal supplied to the enable lines 44 is shared among the plurality of pixel circuits 41. Thus, even when there is a sub-field (SF) for which the light emission period is shorter than one vertical period within which selection of each of the plurality of scan lines 42 is completed, the electro-optical device 10 can be readily driven by simply shortening the second period.

A configuration of a pixel circuit according to First Exemplary Embodiment will now be described using other examples and modified examples. In the description of the following examples and modified examples, the differences from the examples and the modified examples that have already described will be described: in the drawings, like numerals are assigned to the same components as those in the examples and modified examples already described and their description will be omitted. The driving method of the pixel circuit that will be described in the following examples and modified examples is the same as Example 1 and accordingly the same advantageous effect as Example 1 can be obtained in the configuration of the following examples and modified examples.

MODIFIED EXAMPLE 1

Figure 10:
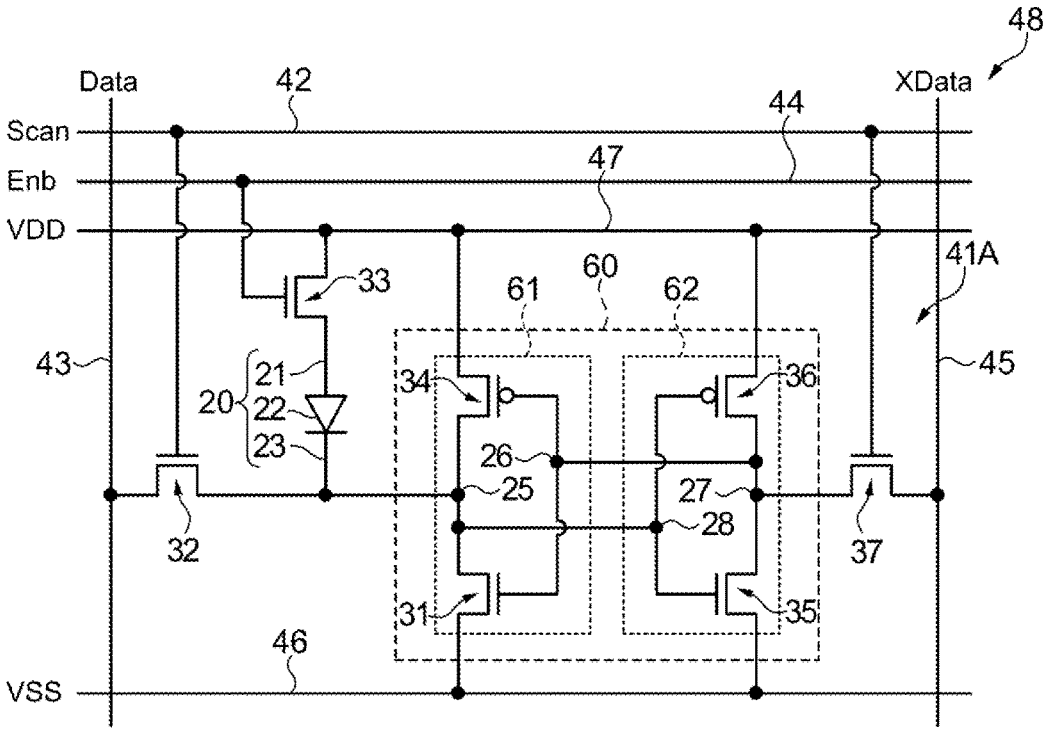
FIG. 10 illustrates a configuration of a pixel circuit according to Modified Example 1.

First, a pixel circuit according to Modified Example 1, which is a modified example of Example 1, will be described. FIG. 10 illustrates a configuration of the pixel circuit according to Modified Example 1. As illustrated in FIG. 10, a pixel circuit 41A according to Modified Example 1 differs from the pixel circuit 41 according to First Exemplary Embodiment in that the third transistor 33 is arranged on the higher potential side than the light emitting element 20 with the other configuration being the same.

In the pixel circuit 41A according to Modified Example 1, the drain of the third transistor 33 is electrically connected to the high potential line 47 that serves as the second potential line, and the source of the third transistor 33 is electrically connected to the anode 21 of the light emitting element 20. The cathode 23 of the light emitting element 20 is electrically connected to the output terminal 25 of the memory circuit 60 (the first inverter 61), that is, the drain of the first transistor 31.

In Modified Example 1, since the third transistor 33 is arranged on the high potential side with respect to the light emitting element 20, it is preferable that the potential of the active signal supplied to the gate of the third transistor 33 from the enable line 44 is set to be higher, e.g. about 10 V, than that of Example 1 in order to prevent the voltage between the gate and the source of the third transistor 33 from decreasing during the second period and in order to prevent the third transistor 33 from failing to be linearly operated.

EXAMPLE 2

Figure 11:
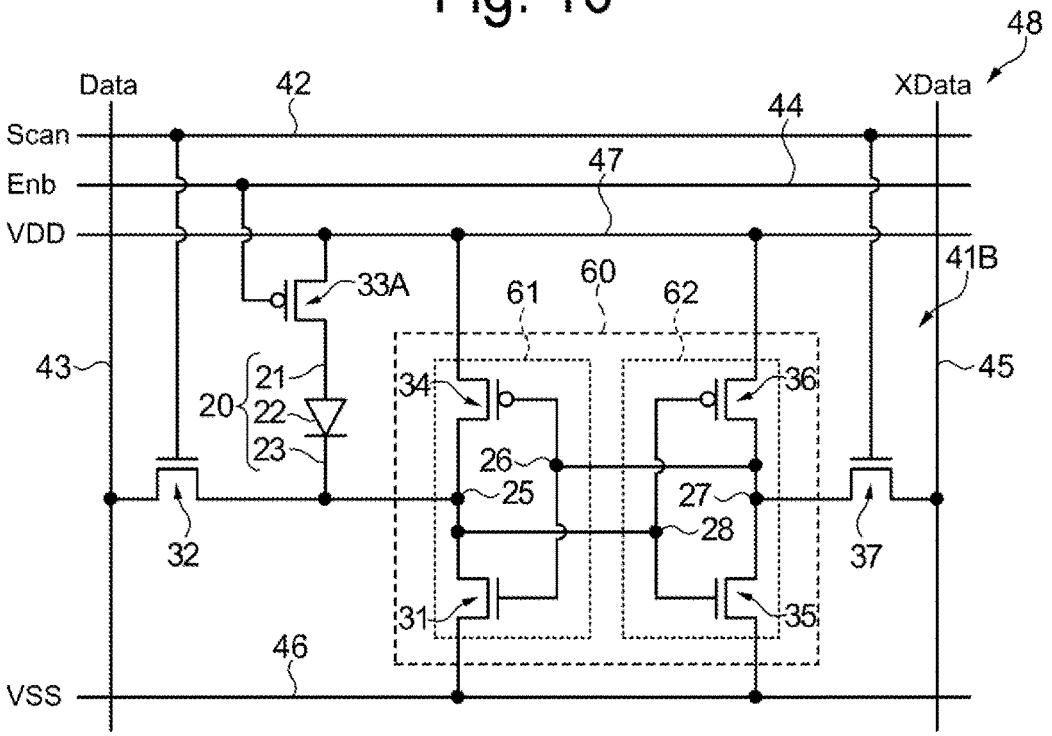
FIG. 11 illustrates a configuration of a pixel circuit according to Example 2.

A configuration of a pixel circuit according to Example 2 will now be described with reference to FIG. 11. FIG. 11 illustrates the configuration of the pixel circuit according to Example 2. As illustrated in FIG. 11, a pixel circuit 41B according to Example 2 differs from the pixel circuits 41 and 41A according to Example 1 and Modified Example 1 in that the third transistor 33A is a P-type transistor.

The pixel circuit 41B according to Example 2 includes the light emitting element 20, the memory circuit 60 that includes the first transistor 31, the second transistor 32, the third transistor 33A, and the complementary second transistor 37. The third transistor 33A, which is a P-type transistor, is arranged in series with the light emitting element 20 between the output terminal 25 of the first inverter 61, that is, the drain of the first transistor 31, and the high potential line 47 that serves as the second potential line.

The third transistor 33A is arranged on the higher potential side than the light emitting element 20. The source of the third transistor 33A is electrically connected to the high potential line 47 that serves as the second potential line. The drain of the third transistor 33A is electrically connected to the anode 21 of the light emitting element 20. The cathode 23 of the light emitting element 20 is electrically connected to the output terminal 25 of the memory circuit 60, i.e. the first inverter 61, that is, the drain of the first transistor 31.

In Example 2, with regard to the enable signal supplied to the third transistor 33A from the enable line 44, the second low potential VSS2 (VSS2=VSS=0 V) is supplied as the active signal and the second high potential VDD2 (VDD2=VDD=5 V) is supplied as the inactive signal for example.

During the first period (the non-display period), when the selection signal, which is supplied from the scan line 42, turns the second transistor 32 and the complementary second transistor 37 into the ON-state, an image signal from the data line 43 and the complementary data line 45 is written to and stored in the memory circuit 60. During the second period (the display period), when the active signal supplied from the enable line 44 turns the third transistor 33A into the ON-state, the path that leads from the high potential line 47 (VDD) to the low potential line 46 (VSS) through the third transistor 33A, the light emitting element 20, and the first transistor 31 can be controlled by the first transistor 31. As a result, the light emitting element 20 emits or does not emit light depending on the image signal.

MODIFIED EXAMPLE 2

Figure 12:
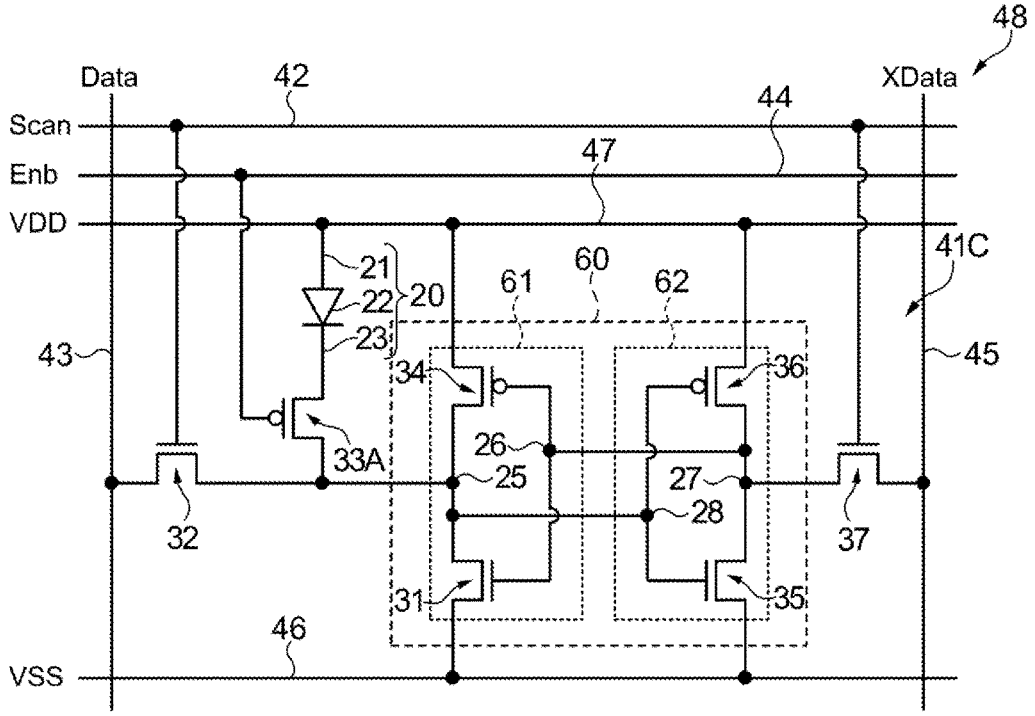
FIG. 12 illustrates a configuration of a pixel circuit according to Modified Example 2.

A configuration of a pixel circuit according to Modified Example 2, which is a modified example of Example 2, will now be described with reference to FIG. 12. FIG. 12 illustrates the configuration of the pixel circuit according to Modified Example 2. As illustrated in FIG. 12, a pixel circuit 41C according to Modified Example 2 differs from the pixel circuit 41B according to Example 2 in that the third transistor 33A is arranged on the lower potential side than the light emitting element 20.

In the pixel circuit 41C according to Modified Example 2, the source of the third transistor 33A is electrically connected to the cathode 23 of the light emitting element 20, and the drain of the third transistor 33A is electrically connected to the output terminal 25 of the memory circuit 60 (the first inverter 61), that is, the drain of the first transistor 31. The anode 21 of the light emitting element 20 is electrically connected to the high potential line 47 that serves as the second potential line.

In Modified Example 2, since the third transistor 33A is arranged on the low potential side with respect to the light emitting element 20, it is preferable that the potential of the active signal supplied to the gate of the third transistor 33A from the enable line 44 is set to be lower than that of Example 1, e.g. about −5 V, in order to prevent the voltage between the gate and the source of the third transistor 33A from decreasing during the second period and in order to prevent the third transistor 33A from failing to be operated linearly.

EXAMPLE 3

Figure 13:
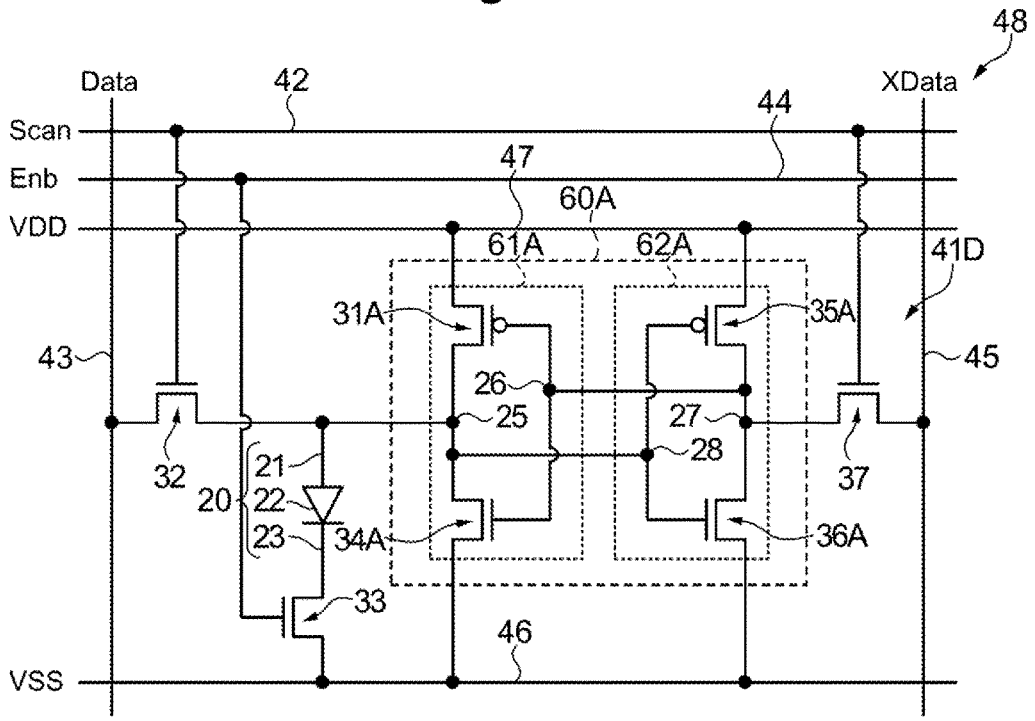
FIG. 13 illustrates a configuration of a pixel circuit according to Example 3.

A configuration of a pixel circuit according to Example 3 will now be described with reference to FIG. 13. FIG. 13 illustrates the configuration of the pixel circuit according to Example 3. As illustrated in FIG. 13, a pixel circuit 41D according to Example 3 differs from the pixel circuit 41 according to Example 1 in that a first transistor 31A and a fifth transistor 35A are each a P-type transistor, and a fourth transistor 34A and a sixth transistor 36A are each an N-type transistor.

The pixel circuit 41D according to Example 3 includes the light emitting element 20, a memory circuit 60A that includes the first transistor 31A, the second transistor 32, the third transistor 33, and the complementary second transistor 37. The memory circuit 60A includes a first inverter 61A and a second inverter 62A. In Example 3, the high potential line 47 serves as the first potential line, and the low potential line 46 serves as the second potential line.

The first inverter 61A includes the P-type first transistor 31A and the N-type fourth transistor 34A. The source of the first transistor 31A is electrically connected to the high potential line 47 that serves as the first potential line. The first transistor 31A is a component of the first inverter 61A and is also a driving transistor for the light emitting element 20. The source of the fourth transistor 34A is electrically connected to the low potential line 46 that serves as the second potential line.

The second inverter 62A includes the P-type fifth transistor 35A and the N-type sixth transistor 36A. The source of the fifth transistor 35A is electrically connected to the high potential line 47 that serves as the first potential line. The source of the sixth transistor 36A is electrically connected to the low potential line 46 that serves as the second potential line.

The third transistor 33 is arranged in series with the light emitting element 20 between the output terminal 25 of the first inverter 61A, that is, the drain of the first transistor 31A, and the low potential line 46 that serves as the second potential line. The third transistor 33 is arranged on the lower potential side than the light emitting element 20. More specifically, the source of the third transistor 33 is electrically connected to the low potential line 46, and the drain of the third transistor 33 is electrically connected to the cathode 23 of the light emitting element 20. The anode 21 of the light emitting element 20 is electrically connected to the drain of the first transistor 31A.

In Example 3, as in Example 1, to the third transistor 33 from the enable line 44, the enable signal of the second high potential VDD2 (VDD2=VDD=5 V) is supplied as the active signal, and the enable signal of the second low potential VSS2 (VSS2=VSS=0 V) is supplied as the inactive signal.

During the first period (the non-display period), when the selection signal, which is supplied from the scan line 42, turns the second transistor 32 and the complementary second transistor 37 into the ON-state, an image signal from the data line 43 and the complementary data line 45 is written to and stored in the memory circuit 60A. During the second period (the display period), when the active signal, which is supplied from the enable line 44, turns the third transistor 33 into the ON-state, the path that leads from the high potential line 47 (VDD) to the low potential line 46 (VSS) through the first transistor 31A, the light emitting element 20, and the third transistor 33 can be controlled by the first transistor 31. As a result, the light emitting element 20 emits or does not emit light depending on the image signal.

MODIFIED EXAMPLE 3

Figure 14:
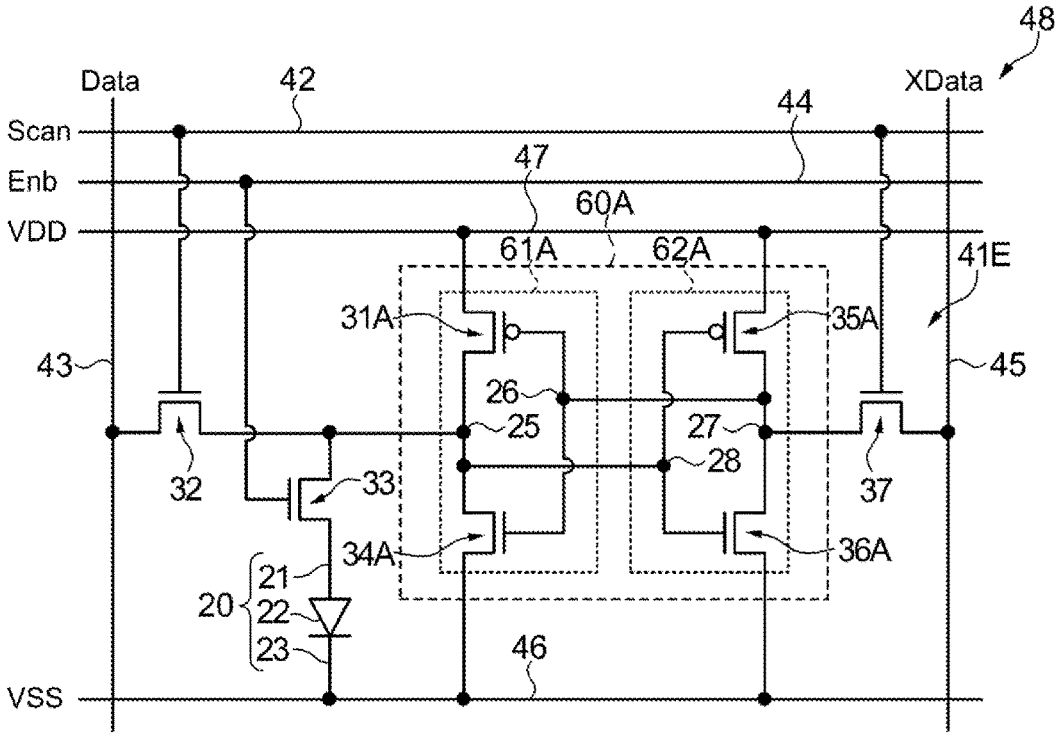
FIG. 14 illustrates a configuration of a pixel circuit according to Modified Example 3.

A configuration of a pixel circuit according to Modified Example 3, which is a modified example of Example 3, will now be described with reference to FIG. 14. FIG. 14 illustrates the configuration of the pixel circuit according to Modified Example 3. As illustrated in FIG. 14, a pixel circuit 41E according to Modified Example 3 differs from the pixel circuit 41D according to Example 3 in that the third transistor 33 is arranged on the higher potential side than the light emitting element 20.

In the pixel circuit 41E according to Modified Example 3, the drain of the third transistor 33 is electrically connected to the output terminal 25 of the first inverter 61A, that is, the drain of the first transistor 31A, and the source of the third transistor 33 is electrically connected to the anode 21 of the light emitting element 20. The cathode 23 of the light emitting element 20 is electrically connected to the low potential line 46 that serves as the second potential line.

In Modified Example 3, since the third transistor 33 is arranged on the high potential side with respect to the light emitting element 20, it is preferable that the voltage of the active signal, which is supplied to the gate of the third transistor 33 from the enable line 44, is set to be higher, e.g. about 10 V, than that of Example 3 in order to prevent the voltage between the gate and the source of the third transistor 33 from decreasing during the second period and in order to prevent the third transistor 33 from failing to be operated linearly.

EXAMPLE 4

Figure 15:
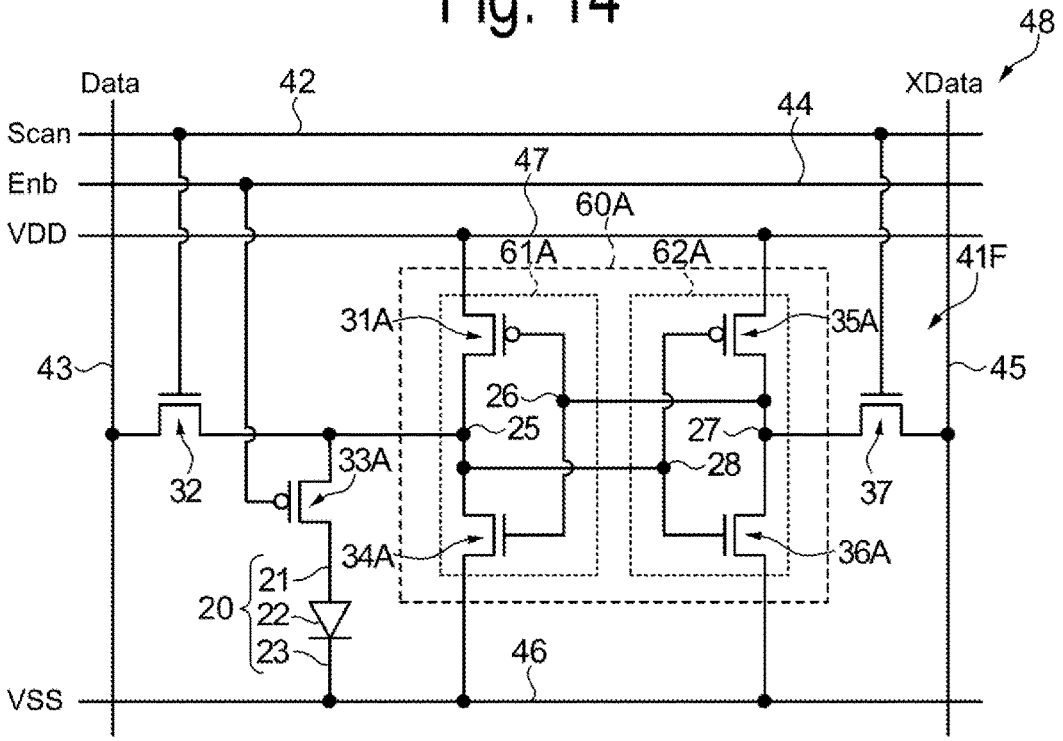
FIG. 15 illustrates a configuration of a pixel circuit according to Example 4.

A configuration of a pixel circuit according to Example 4 will now be described with reference to FIG. 15. FIG. 15 illustrates the configuration of the pixel circuit according to Example 4. As illustrated in FIG. 15, a pixel circuit 41F according to Example 4 differs from the pixel circuit 41D according to Example 3 in that the third transistor 33A is a P-type transistor.

The pixel circuit 41F according to Example 4 includes the light emitting element 20, the memory circuit 60A that includes the first transistor 31A, the second transistor 32, the third transistor 33A, and the complementary second transistor 37. The third transistor 33A, which is a P-type transistor, is arranged in series with the light emitting element 20 between the output terminal 25 of the first inverter 61, that is, the drain of the first transistor 31A, and the low potential line 46 that serves as the second potential line.

The third transistor 33A is arranged on the higher potential side than the light emitting element 20. The source of the third transistor 33A is electrically connected to the drain of the first transistor 31A. The drain of the third transistor 33A is electrically connected to the anode 21 of the light emitting element 20. The cathode 23 of the light emitting element 20 is electrically connected to the low potential line 46.

In Example 4, with regard to the enable signal supplied to the third transistor 33A from the enable line 44 the enable signal of the second low potential VSS2 (VSS2=VSS=0 V) is supplied as the active signal, and the enable signal of the second high potential VDD2 (VDD2=VDD=5 V) is supplied as the inactive signal, for example.

During the first period (the non-display period), when the selection signal, which is supplied from the scan line 42, turns the second transistor 32 and the complementary second transistor 37 into the ON-state, an image signal from the data line 43 and the complementary data line 45 is written to and stored in the memory circuit 60A. During the second period (the display period), when the active signal, which is supplied from the enable line 44, turns the third transistor 33 into the ON-state, the path that leads from the high potential line 47 (VDD) to the low potential line 46 (VSS) through the first transistor 31A, the third transistor 33A, and the light emitting element 20 can be controlled by the first transistor 31. As a result, the light emitting element 20 emits or does not emit light depending on the image signal.

MODIFIED EXAMPLE 4

Figure 16:
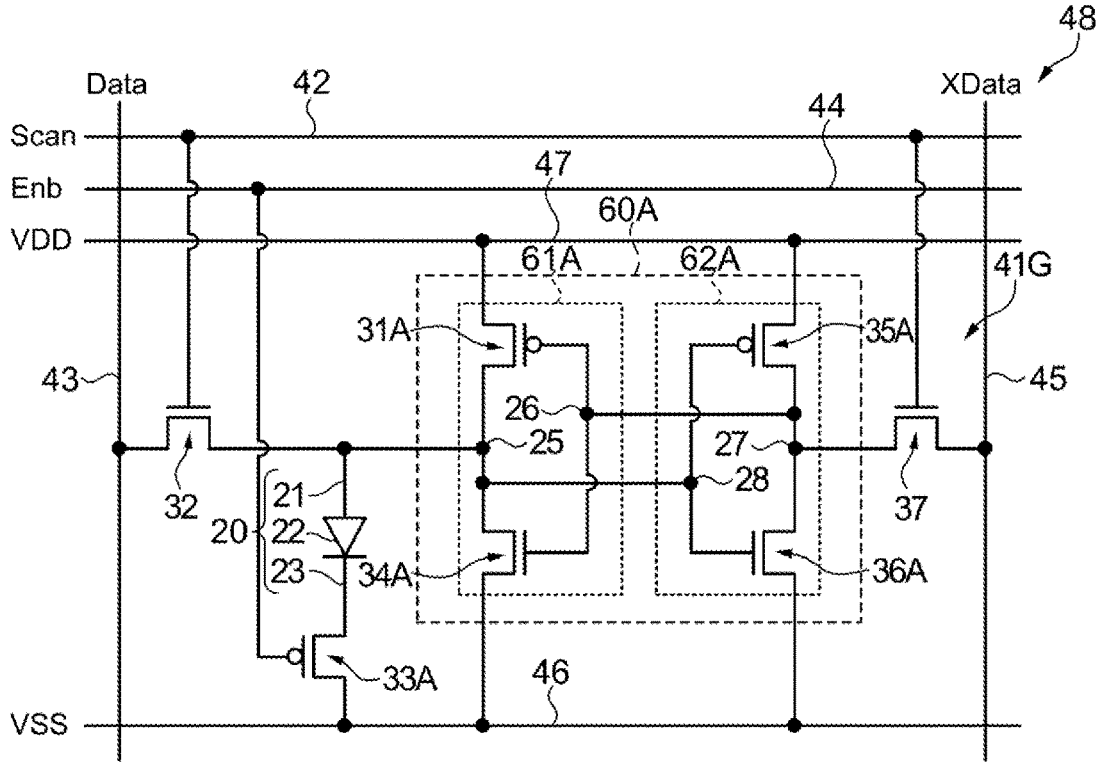
FIG. 16 illustrates a configuration of a pixel circuit according to Modified Example 4.

A configuration of a pixel circuit according to Modified Example 4, which is a modified example of Example 4, will now be described with reference to FIG. 16. FIG. 16 illustrates the configuration of the pixel circuit according to Modified Example 4. As illustrated in FIG. 16, a pixel circuit 41G according to Modified Example 4 differs from the pixel circuit 41F according to Example 4 in that the third transistor 33A is arranged on the lower potential side than the light emitting element 20.

In the pixel circuit 41G according to Modified Example 4, the source of the third transistor 33A is electrically connected to the cathode 23 of the light emitting element 20, and the drain of the third transistor 33A is electrically connected to the low potential line 46 that serves as the second potential line. The anode 21 of the light emitting element 20 is electrically connected to the output terminal 25 of the first inverter 61A, that is, the drain of the first transistor 31A.

In Modified Example 4, since the third transistor 33A is arranged on the low potential side with respect to the light emitting element 20, it is preferable that the voltage of the active signal, which is supplied to the gate of the third transistor 33A from the enable line 44, is set to be lower, e.g. about −5 V, than that of Example 1 in order to prevent the voltage between the gate and the source of the third transistor 33A from decreasing during the second period and in order to prevent the third transistor 33A from failing to be operated linearly.

Second Exemplary Embodiment

A configuration of an electro-optical device according to Second Exemplary Embodiment will now be described. The electro-optical device according to Second Exemplary Embodiment, whose illustration is omitted, differs from the electro-optical device 10 according to First Exemplary Embodiment in that the enable line drive circuit 54 and the enable lines 44 (refer to FIG. 5) do not exist. Accordingly, a configuration of a pixel circuit according to Second Exemplary Embodiment also differs from the configuration of the pixel circuit according to First Exemplary Embodiment. Specifically, the pixel circuit according to Second Exemplary Embodiment differs from that according to First Exemplary Embodiment in that the gate of the second transistor and the gate of the third transistor are electrically connected to the scan line, and the second transistor and the third transistor have polarities opposite to each other.

A configuration of the pixel circuit according to Second Exemplary Embodiment will now be described using a plurality of examples and modified examples. In the description of the following examples and modified examples, the differences from the examples and the modified examples that have already described will be described. In the drawings, like numerals are assigned to the same components as those in the examples and modified examples already described and their description will be omitted.

Configuration of Pixel Circuit

EXAMPLE 5

Figure 17:
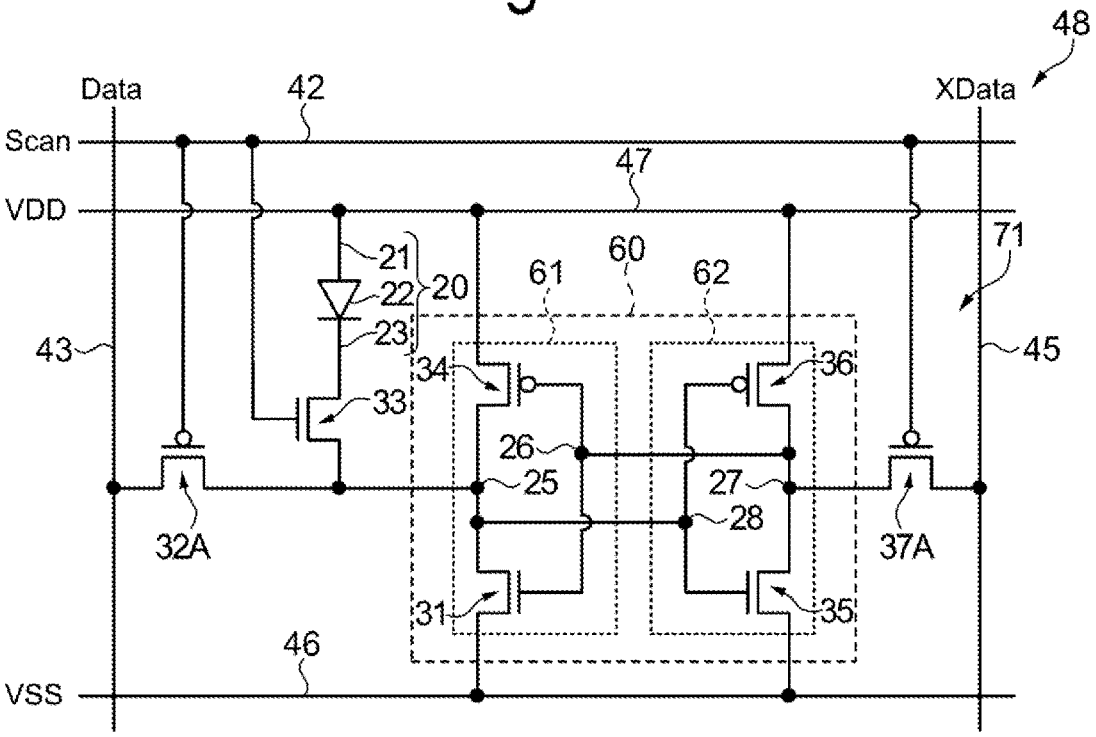
FIG. 17 illustrates a configuration of a pixel circuit according to Example 5.

A configuration of a pixel circuit according to Example 5 will now be described with reference to FIG. 17. FIG. 17 illustrates the configuration of the pixel circuit according to Example 5. As illustrated in FIG. 17, a pixel circuit 71 is provided for each of the sub-pixels 48 that are arranged to correspond to the respective intersections of the scan lines 42 and the data lines 43. The scan line 42, the data line 43, and the complementary data line 45 correspond to each pixel circuit 71. As described above, in Second Exemplary Embodiment, no enable line is provided but the scan lines 42 also function as the enable lines.

The pixel circuit 71 according to Example 5 includes the light emitting element 20, the memory circuit 60 that includes the first transistor 31, a second transistor 32A, the third transistor 33, and a complementary second transistor 37A. The pixel circuit 71 according to Example 5 differs from the pixel circuit 41 according to Example 1 in that the gate of the third transistor 33 is electrically connected to the scan line 42, and both the second transistor 32A and the complementary second transistor 37A are P-type transistors, which have an opposite polarity to the third transistor 33.

The gates of the second transistor 32A and the complementary second transistor 37A, which are P-type transistors, are electrically connected to the scan line 42, and the gate of the third transistor 33, which is an N-type transistor, is also electrically connected to the scan line 42. Accordingly, depending on the scan signal, which serves as the enable signal and which is supplied from the scan line 42, when the second transistor 32A and the complementary second transistor 37A are turned into the ON-state, the third transistor 33 is turned into the OFF-state; by contrast when the second transistor 32A and the complementary second transistor 37A are turned into the OFF-state, the third transistor 33 is turned into the ON-state.

During the first period (the non-display period) a Low signal, e.g. 0 V, as the selection signal of the scan signal and also as the inactive signal of the enable signal is supplied from the scan line 42 to the transistors. Accordingly, the second transistor 32A and the complementary second transistor 37A are turned into the ON-state, thus, the data line 43 and the output terminal 25 of the memory circuit (the first inverter 61) are electrically conducted while, at the same time, the complementary data line 45 and the output terminal 27 of the memory circuit 60 (the second inverter 62) are electrically conducted. Consequently, an image signal and an inverted signal relative to the image signal are written to and stored in the memory circuit 60. During the first period the light emitting element 20 is not allowed to emit light, because the third transistor 33 is in the OFF-state.

During the second period (the display period), a High signal, e.g. 5 V, as the non-selection signal of the scan signal and also as the active signal of the enable signal is supplied from the scan line 42 to the transistors. Accordingly, the third transistor 33 is turned into the ON-state, thus, the path that leads from the high potential line 47 (VDD) to the low potential line 46 (VSS) through the light emitting element 20, the third transistor 33, and the first transistor 31 can be electrically conducted. This means the light emitting element 20 can emit light. Furthermore, the image signal stored in the memory circuit 60 is maintained, because the second transistor 32A and the complementary second transistor 37A are in the OFF-state.

Now we consider an imaginary circuit in which the third transistor 33 is not provided in the pixel circuit 71 according to Example 5. In the imaginary circuit, since a current can flow through the light emitting element 20 while an image signal is written to the memory circuit 60, it can be time-consuming to rewrite the image signal at the memory circuit 60 at best, but correct image signals may not be stored in the memory circuit 60 at worst. By contrast, in this Exemplary Embodiment, the third transistor 33 is in the OFF-state to prevent a current from flowing through the light emitting element 20 when an image signal is written to the memory circuit 60. As a result, a high-quality image without any display errors can be achieved.

In this way, in the pixel circuit 71 according to Example 5 of Second Exemplary Embodiment, the gate of the second transistor 32A and the gate of the third transistor 33 are electrically connected to the scan line 42, and the second transistor 32A (P-type) and the third transistor 33 (N-type) have polarities opposite to each other. With such a configuration, the scan line 42 also functions as the enable line, thus reducing the number of wires and the number of wiring layers.

In general a large number of wire layers increases the number of production steps for the electro-optical device (element substrate) and reduces the production yield, because one wire layer needs one interlayer insulating layer. With the configuration of Second Exemplary Embodiment, image display can be provided by digital driving even with a relatively small number of wire layers. Therefore, the number of production steps can be reduced and the production yield can be improved as compared to First Exemplary Embodiment. In addition, with a reduced number of light-shielding wires, the area that shields light can be decreased to achieve high resolution (fine pixels).

MODIFIED EXAMPLE 5

Figure 18:
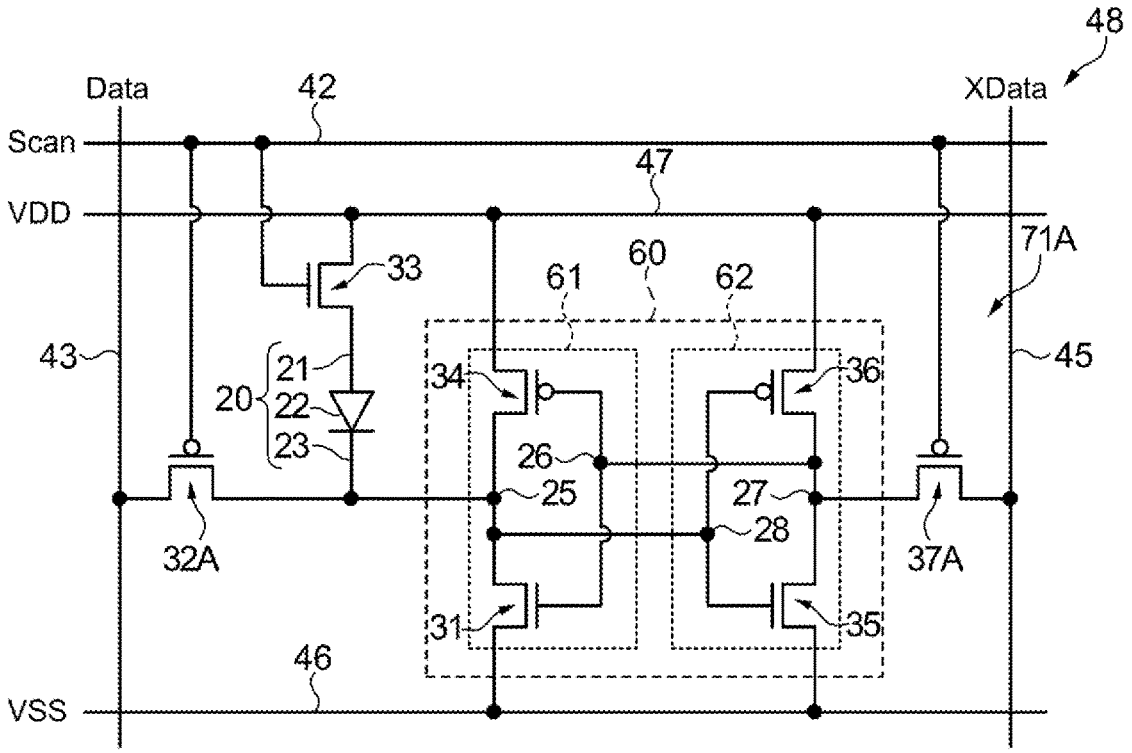
FIG. 18 illustrates a configuration of a pixel circuit according to Modified Example 5.

A pixel circuit according to Modified Example 5, which is a modified example of Example 5, will now be described. FIG. 18 illustrates the configuration of the pixel circuit according to Modified Example 5. As illustrated in FIG. 18, a pixel circuit 71A according to Modified Example 5 differs from the pixel circuit 71 according to Example 5 in that the third transistor 33 is arranged on the higher potential side than the light emitting element 20.

In the pixel circuit 71A according to Modified Example 5, the drain of the third transistor 33 is electrically connected to the high potential line 47 that serves as the second potential line, and the source of the third transistor 33 is electrically connected to the anode 21 of the light emitting element 20. The cathode 23 of the light emitting element 20 is electrically connected to the output terminal 25 of the memory circuit 60 (the first inverter 61), that is, the drain of the first transistor 31.

In Modified Example 3, since the third transistor 33 is arranged on the high potential side with respect to the light emitting element 20, it is preferable that the voltage of the scan signal, which is serving as the non-selection signal and also as the active signal, supplied to the gate of the third transistor 33 from the scan line 42 is set to be higher, e.g. about 10 V, than that of Example 5 in order to prevent the voltage between the gate and the source of the third transistor 33 from decreasing during the second period and in order to prevent the third transistor 33 from failing to be operated linearly.

EXAMPLE 6

Figure 19:
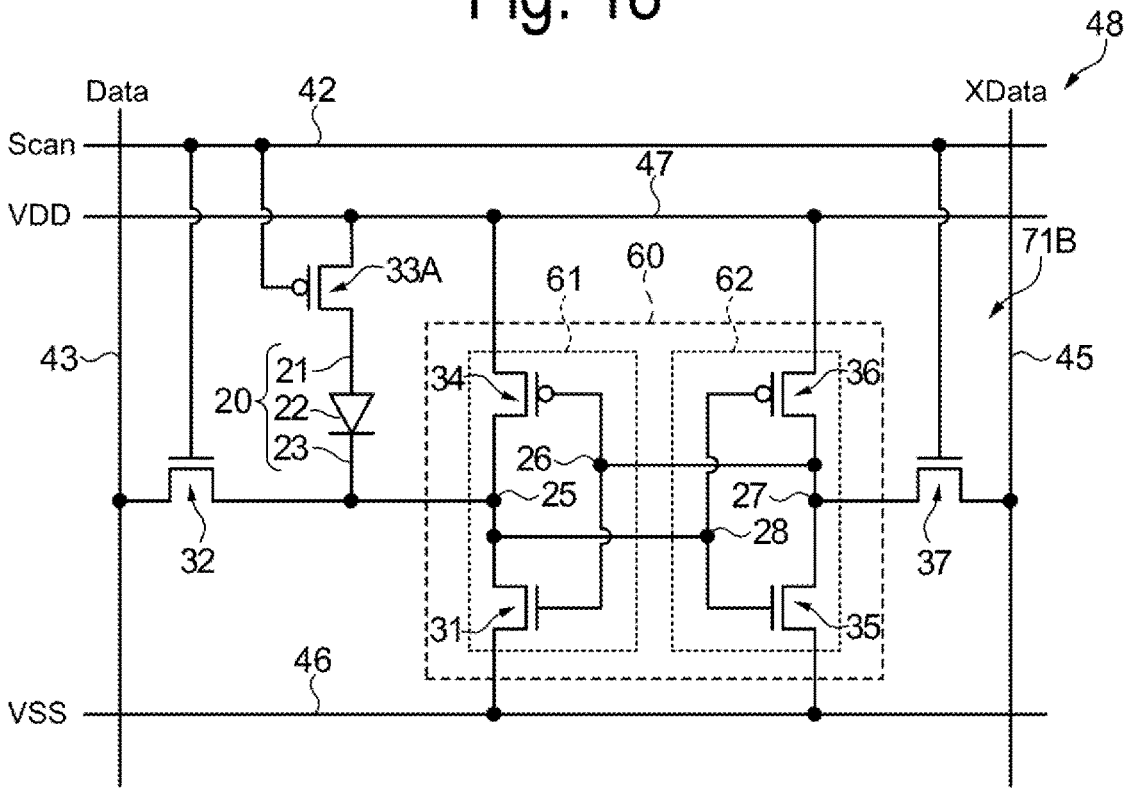
FIG. 19 illustrates a configuration of a pixel circuit according to Example 6.

A pixel circuit according to Example 6 will now be described. FIG. 19 illustrates a configuration of the pixel circuit according to Example 6. As illustrated in FIG. 19, a pixel circuit 71B according to Example 6 differs from the pixel circuit 71 according to Example 5 in that the third transistor 33A is a P-type transistor, and both the second transistor 32 and the complementary second transistor 37 are N-type transistors.

The pixel circuit 71B according to Example 6 includes the light emitting element 20, the memory circuit 60 that includes the first transistor 31, the second transistor 32, the third transistor 33A, and the complementary second transistor 37. The third transistor 33A, which is a P-type transistor, is arranged in series with the light emitting element 20 between the output terminal 25 of the first inverter 61, i.e. the drain of the first transistor 31, and the high potential line 47 that serves as the second potential line.

The third transistor 33A is arranged on the higher potential side than the light emitting element 20. The source of the third transistor 33A is electrically connected to the high potential line 47 that serves as the second potential line. The drain of the third transistor 33A is electrically connected to the anode 21 of the light emitting element 20. The cathode 23 of the light emitting element 20 is electrically connected to the output terminal 25 of the memory circuit 60 (the first inverter 61), that is, the drain of the first transistor 31.

During the first period (the non-display period), a High signal, e.g. 5 V, as the selection signal of the scan signal and also as the inactive signal of the enable signal is supplied from the scan line 42 to transistors. Accordingly, the second transistor 32 and the complementary second transistor 37 are turned into the ON-state, such that an image signal from the data line 43 and the complementary data line 45 is written to and stored in the memory circuit 60. During the first period the light emitting element 20 is not allowed to emit light, because the third transistor 33A is in the OFF-state.

During the second period (the display period), a Low signal, e.g. 0 V, as the non-selection signal of the scan signal and also as the active signal of the enable signal is supplied from the scan line 42 to the transistors. Accordingly, the third transistor 33A is turned into the ON-state, thus, the path that leads from the high potential line 47 (VDD) to the low potential line 46 (VSS) through the third transistor 33A, the light emitting element 20, and the first transistor 31 can be controlled by the first transistor 31. As a result, the light emitting element 20 emits or does not emit light depending on the image signal. Furthermore, the image signal stored in the memory circuit 60 is maintained, because the second transistor 32 and the complementary second transistor 37 are in the OFF-state.

MODIFIED EXAMPLE 6

Figure 20:
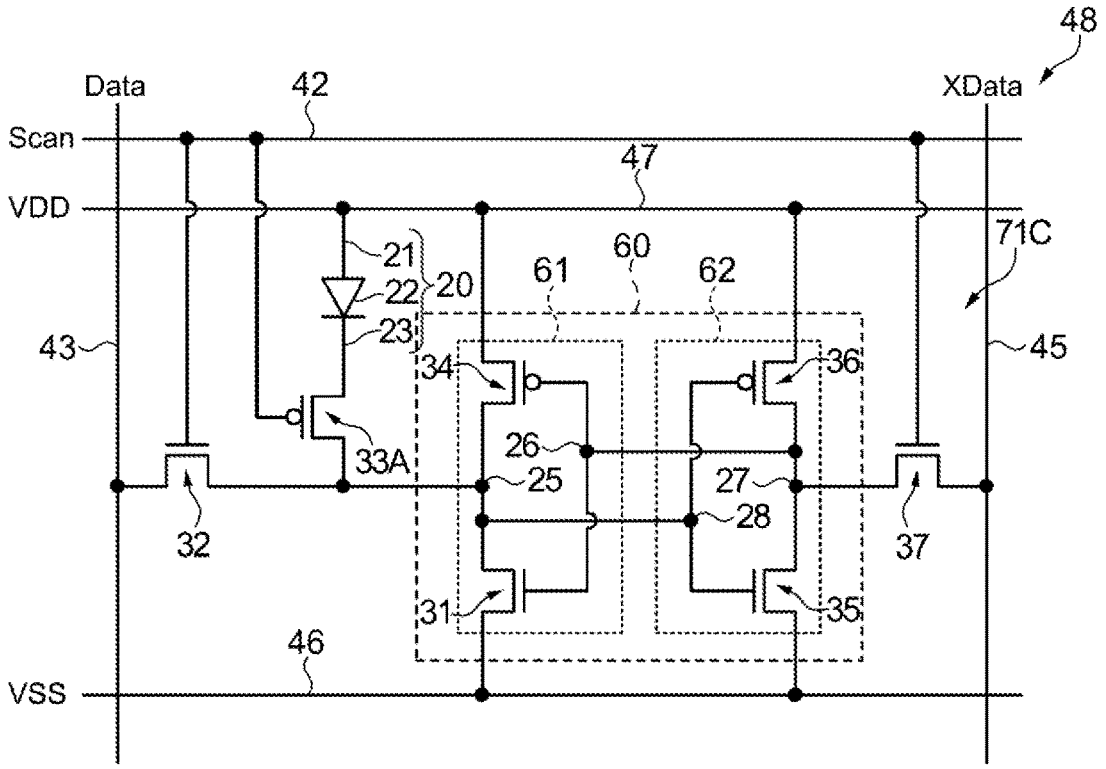
FIG. 20 illustrates a configuration of a pixel circuit according to Modified Example 6.

A configuration of a pixel circuit according to Modified Example 6, which is a modified example of Example 6, will now be described with reference to FIG. 20. FIG. 20 illustrates the configuration of the pixel circuit according to Modified Example 6. As illustrated in FIG. 20, a pixel circuit 71C according to Modified Example 6 differs from the pixel circuit 71B according to Example 6 in that the third transistor 33A is arranged on the lower potential side than the light emitting element 20.

In the pixel circuit 71C according to Modified Example 6, the source of the third transistor 33A is electrically connected to the cathode 23 of the light emitting element 20, and the drain of the third transistor 33A is electrically connected to the output terminal 25 of the first inverter 61, that is, the drain of the first transistor 31. The anode 21 of the light emitting element 20 is electrically connected to the high potential line 47.

In Modified Example 6, since the third transistor 33A is arranged on the low potential side with respect to the light emitting element 20, it is preferable that the voltage of the scan signal that is serving as the non-selection signal and also as the active signal supplied to the gate of the third transistor 33A from the scan line 42 is set to be lower, e.g. about −5 V, than that of Example 6 in order to prevent the voltage between the gate and the source of the third transistor 33A from decreasing during the second period and in order to prevent the third transistor 33A from failing to be operated linearly.

EXAMPLE 7

Figure 21:
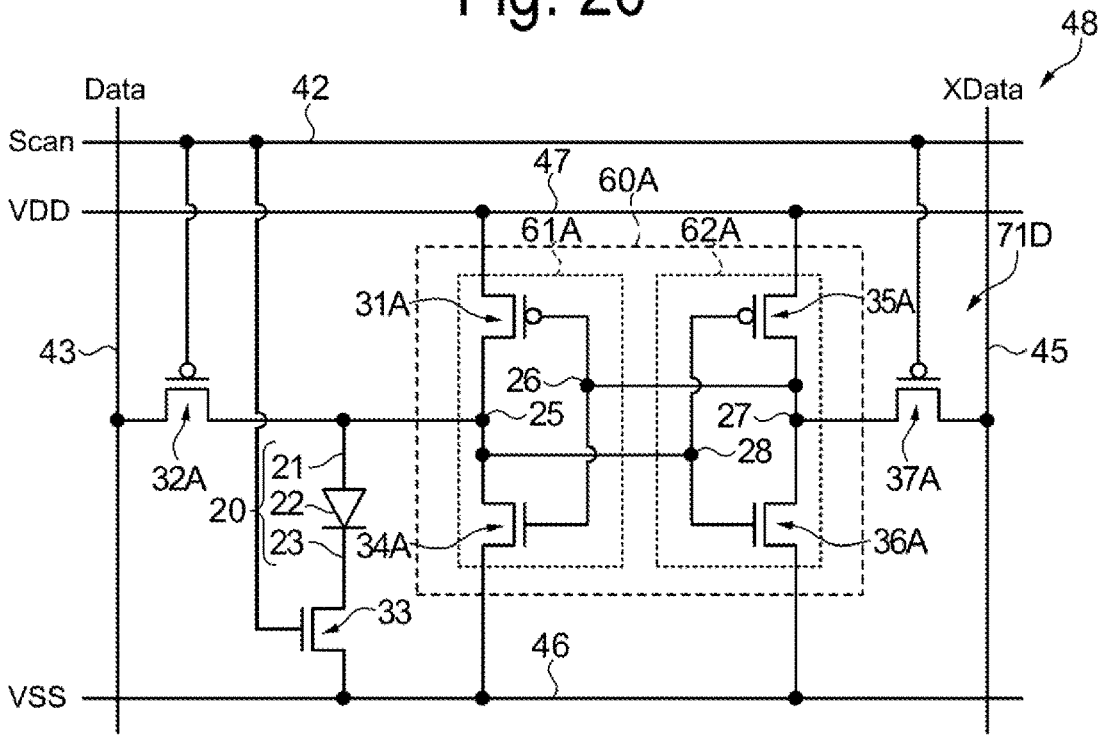
FIG. 21 illustrates a configuration of a pixel circuit according to Example 7.

A pixel circuit according to Example 7 will now be described. FIG. 21 illustrates a configuration of the pixel circuit according to Example 7. As illustrated in FIG. 21, a pixel circuit 71D according to Example 7 differs from the pixel circuit 71 according to Example 5 in that the first transistor 31A and the fifth transistor 35A are P-type transistors, and the fourth transistor 34A and the sixth transistor 36A are N-type transistors.

The pixel circuit 71D according to Example 7 includes the light emitting element 20, the memory circuit 60A that includes the first transistor 31A, the second transistor 32A, the third transistor 33, and the complementary second transistor 37A. The memory circuit 60A includes the first inverter 61A and the second inverter 62A. In Example 7, the high potential line 47 serves as the first potential line, and the low potential line 46 serves as the second potential line.

The first inverter 61A includes the P-type first transistor 31A and the N-type fourth transistor 34A. The source of the first transistor 31A is electrically connected to the high potential line 47 that serves as the first potential line. The first transistor 31A is a component of the first inverter 61A and is also a driving transistor for the light emitting element 20. The source of the fourth transistor 34A is electrically connected to the low potential line 46 that serves as the second potential line.

The second inverter 62A includes the P-type fifth transistor 35A and the N-type sixth transistor 36A. The source of the fifth transistor 35A is electrically connected to the high potential line 47 that serves as the first potential line. The source of the sixth transistor 36A is electrically connected to the low potential line 46 that serves as the second potential line.

The third transistor 33 is arranged in series with the light emitting element 20 between the output terminal 25 of the first inverter 61A, that is, the drain of the first transistor 31A, and the low potential line 46 that serves as the second potential line. The third transistor 33 is arranged on the low potential side with respect to the light emitting element 20. More specifically, the source of the third transistor 33 is electrically connected to the low potential line 46, and the drain of the third transistor 33 is electrically connected to the cathode 23 of the light emitting element 20. The anode 21 of the light emitting element 20 is electrically connected to the drain of the first transistor 31A.

In Example 7, during the first period (the non-display period), when the Low signal that is serving as the selection signal and also as the inactive signal is supplied from the scan line 42 to the second transistor 32A and the complementary second transistor 37A, these transistors are turned into the ON-state, and an image signal from the data line 43 and the complementary data line 45 is written to and stored in the memory circuit 60A. During the second period (the display period), when the High signal that is serving as the non-selection signal and also as the active signal is supplied from the scan line 42 to the third transistor 33, the third transistor 33 is turned into the ON-state, thus, the path that leads from the high potential line 47 (VDD) to the low potential line 46 (VSS) through the first transistor 31A, the light emitting element 20, and the third transistor 33 can be controlled by the first transistor 31A. As a result, the light emitting element 20 emits or does not emit light depending on the image signal.

MODIFIED EXAMPLE 7

Figure 22:
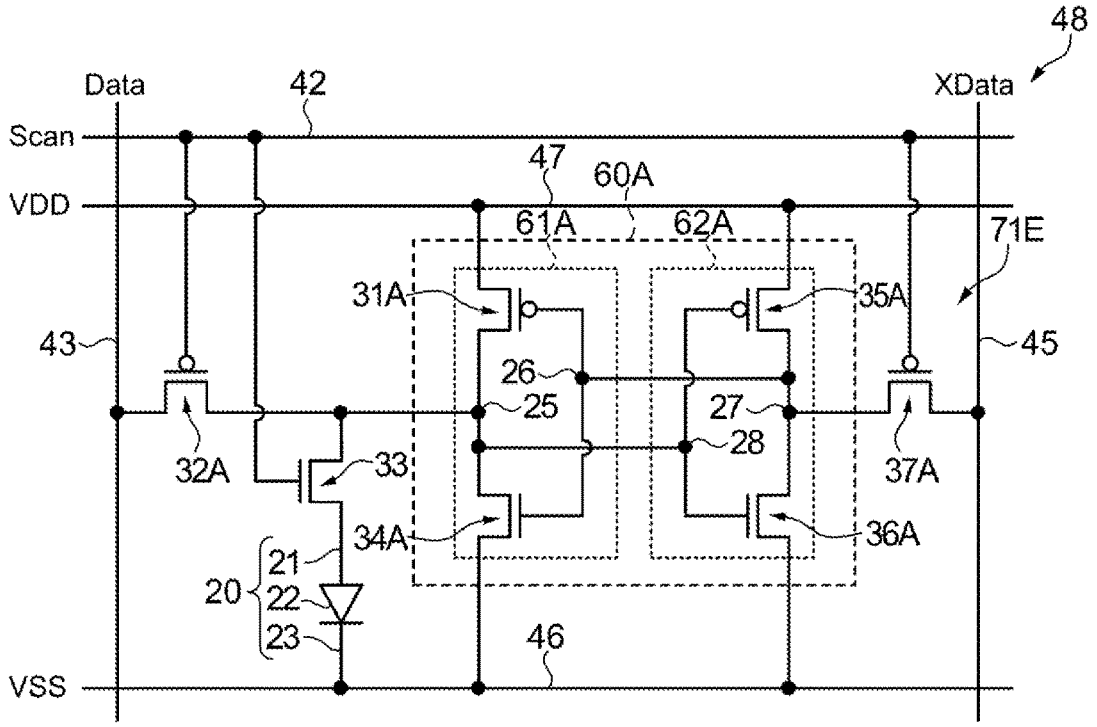
FIG. 22 illustrates a configuration of a pixel circuit according to Modified Example 7.

A configuration of a pixel circuit according to Modified Example 7, which is a modified example of Example 7, will now be described with reference to FIG. 22. FIG. 22 illustrates the configuration of the pixel circuit according to Modified Example 7. As illustrated in FIG. 22, a pixel circuit 71E according to Modified Example 7 differs from the pixel circuit 71D according to Example 7 in that the third transistor 33 is arranged on the higher potential side than the light emitting element 20.

In the pixel circuit 71E according to Modified Example 7, the drain of the third transistor 33 is electrically connected to the output terminal 25 of the first inverter 61A, that is, the drain of the first transistor 31A, and the source of the third transistor 33 is electrically connected to the anode 21 of the light emitting element 20. The cathode 23 of the light emitting element 20 is electrically connected to the low potential line 46 that serves as the second potential line.

In Modified Example 7, since the third transistor 33 is arranged on the high potential side with respect to the light emitting element 20, it is preferable that the voltage of the scan signal, which is serving as the non-selection signal and also as the active signal, and which is supplied to the gate of the third transistor 33 from the scan line 42, is set to be higher, e.g. about 10 V, than that of Example 7 in order to prevent the voltage between the gate and the source of the third transistor 33 from decreasing during the second period and in order to prevent the third transistor 33 from failing to be operated linearly.

EXAMPLE 8

Figure 23:
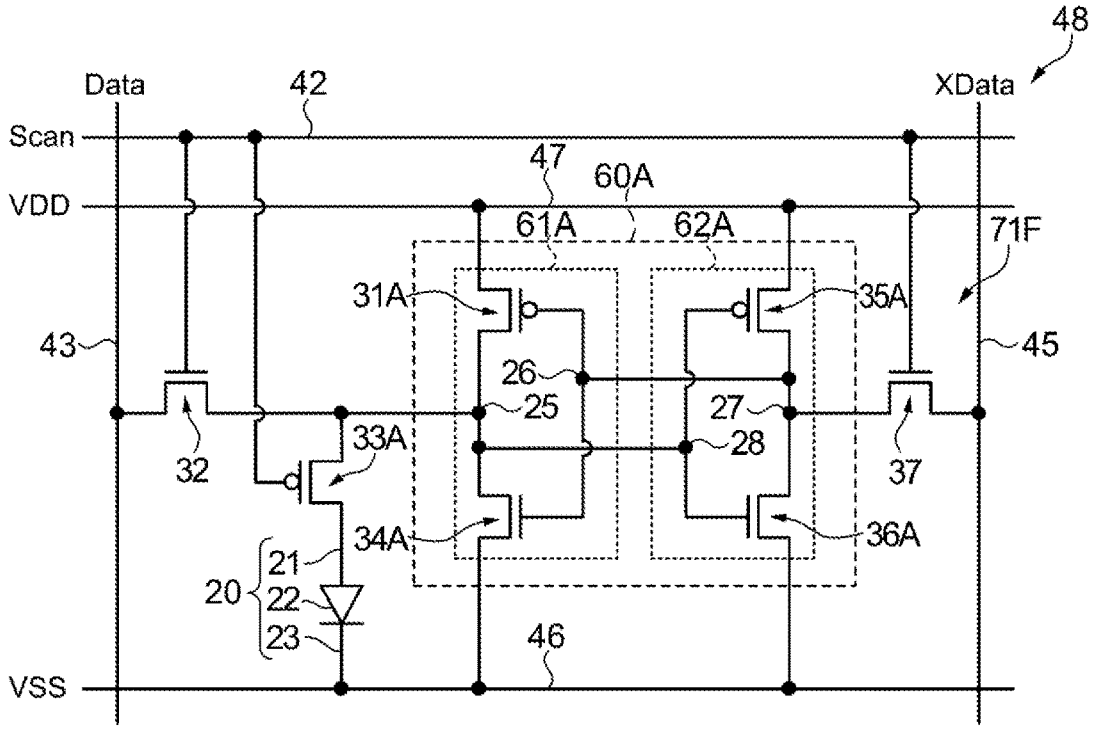
FIG. 23 illustrates a configuration of a pixel circuit according to Example 8.

A configuration of a pixel circuit according to Example 8 will now be described with reference to FIG. 23. FIG. 23 illustrates the configuration of the pixel circuit according to Example 8. As illustrated in FIG. 23, a pixel circuit 71F according to Example 8 differs from the pixel circuit 71D according to Example 7 in that the third transistor 33A is a P-type transistor, and the second transistor 32 and the complementary second transistor 37 are each an N-type transistor.

The pixel circuit 71F according to Example 8 includes the light emitting element 20, the memory circuit 60A that includes the first transistor 31A, the second transistor 32, the third transistor 33A, and the complementary second transistor 37. The third transistor 33A, which is a P-type transistor, is arranged in series with the light emitting element 20 between the output terminal 25 of the first inverter 61, that is, the drain of the first transistor 31A, and the low potential line 46 that serves as the second potential line.

The third transistor 33A is arranged on the higher potential side than the light emitting element 20. The source of the third transistor 33A is electrically connected to the drain of the first transistor 31A. The drain of the third transistor 33A is electrically connected to the anode 21 of the light emitting element 20. The cathode 23 of the light emitting element 20 is electrically connected to the low potential line 46.

In Example 8, during the first period (the non-display period), when a High signal that is serving as the selection signal and also as the inactive signal is supplied from the scan line 42 to the second transistor 32 and the complementary second transistor 37, these transistors are turned into the ON-state, and an image signal from the data line 43 and the complementary data line 45 is written to and stored in the memory circuit 60A. During the second period (the display period), when the Low signal that is serving as the non-selection signal and also as the active signal is supplied from the scan line 42 to the third transistor 33, the third transistor 33 is turned into the ON-state, thus, the path that leads from the high potential line 47 (VDD) to the low potential line 46 (VSS) through the first transistor 31A, the third transistor 33A, and the light emitting element 20, can be controlled by the first transistor 31A. As a result, the light emitting element 20 emits or does not emit light depending on the image signal.

MODIFIED EXAMPLE 8

Figure 24:
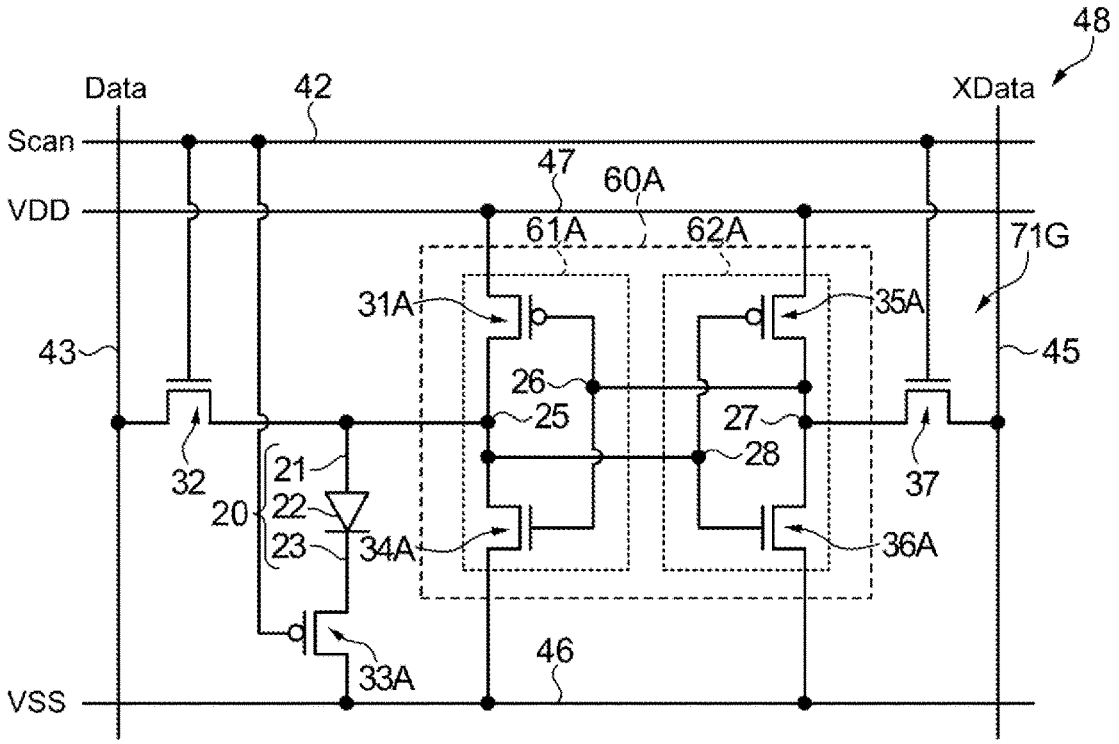
FIG. 24 illustrates a configuration of a pixel circuit according to Modified Example 8.

A configuration of a pixel circuit according to Modified Example 8, which is a modified example of Example 8, will now be described with reference to FIG. 24. FIG. 24 illustrates the configuration of the pixel circuit according to Modified Example 8. As illustrated in FIG. 24, a pixel circuit 71G according to Modified Example 8 differs from the pixel circuit 71F according to Example 8 in that the third transistor 33A is arranged on the lower potential side than the light emitting element 20.

In the pixel circuit 71G according to Modified Example 8, the source of the third transistor 33A is electrically connected to the cathode 23 of the light emitting element 20, and the drain of the third transistor 33A is electrically connected to the low potential line 46 that serves as the second potential line. The anode 21 of the light emitting element 20 is electrically connected to the output terminal 25 of the first inverter 61A, that is, the drain of the first transistor 31A.

In Modified Example 8, since the third transistor 33A is arranged on the low potential side with respect to the light emitting element 20, it is preferable that the voltage of the scan signal that is serving as the non-selection signal and also as the active signal and is supplied to the gate of the third transistor 33A from the scan line 42 is set to be lower, e.g. about −5 V, than that of Example 8 in order to prevent the voltage between the gate and the source of the third transistor 33A from decreasing during the second period and in order to prevent the third transistor 33A from failing to be operated linearl.

The exemplary embodiments (the examples and the modified examples) described above merely represent one aspect of the present disclosure and any variation and application may be possible within the scope of the disclosure. For example, the followings are modified examples other than those described above.

MODIFIED EXAMPLE 9

While the memory circuit 60 (or 60A) in the pixel circuit of the exemplary embodiments (the examples and the modified examples) described above includes two inverters 61 and 62 (or 61A and 62A), the present disclosure is not limited to such an aspect. The memory circuit 60 (or 60A) may be configured to include two or any greater even number of inverters.

MODIFIED EXAMPLE 10

While in the exemplary embodiments described above, an organic EL device in which the light emitting elements 20 each including an organic EL element are arranged in 720 rows×3840 (1280×3) columns on the element substrate 11 formed from a single-crystal semiconductor substrate (a single-crystal silicon wafer) is described as an exemplary electro-optical device, the electro-optical device of the present disclosure is not limited to such an aspect. For example, the electro-optical device may be configured with thin film transistors (TFTs) to serve as the transistors formed on the element substrate 11 formed from a glass substrate, or it may be configured with TFTs formed on a flexible substrate formed of polyimide and the like. Alternatively, the electro-optical device may be a micro LED display in which fine LED elements serving as light emitting elements are arranged at high density, or it may be a quantum dot display using a nano-sized semiconductor crystalline material as a light emitting element. The electro-optical device may use, as a color filter, quantum dots that can convert incident light into light with a different wavelength.

MODIFIED EXAMPLE 11

While in the exemplary embodiments described above, the see-through-type head-mounted display 100 with an integrated electro-optical device 10 is described as an exemplary electronic apparatus, the electro-optical device 10 of the present disclosure may be applied to other types of electronic apparatus including closed-type head-mounted displays. Other types of electronic apparatus include, for example, projectors, rear-projection televisions, direct-viewing televisions, cell phones, portable audio devices, personal computers, video camera monitors, automotive navigation devices, head-up displays, pagers, electronic organizers, calculators, wearable devices such as wristwatches, handheld displays, word processors, workstations, video phones, POS terminals, digital still cameras, signage displays, and the like.

The entire disclosure of Japanese Patent Application No. 2017-185867, filed Sep. 27, 2017 is expressly incorporated by reference herein.

What is claimed is:

1. An electro-optical device comprising:

a scan line;

a data line;

a pixel circuit located at a position corresponding to an intersection of the scan line and the data line;

a first potential line supplying a first potential; and a second potential line supplying a second potential that differs from the first potential, wherein the pixel circuit includes a light emitting element, a memory circuit including a first transistor, a second transistor arranged between the memory circuit and the data line, and a third transistor, a source of the first transistor is electrically connected to the first potential line, and the light emitting element and the third transistor are arranged in series between a drain of the first transistor and the second potential line.

2. The electro-optical device according to claim 1, wherein a drain of the third transistor and the light emitting element are electrically connected to each other.

3. The electro-optical device according to claim 1, wherein an ON-resistance of the third transistor is lower than an ON-resistance of the light emitting element.

4. The electro-optical device according to claim 1, wherein an ON-resistance of the first transistor is lower than or equal to an ON-resistance of the third transistor.

5. The electro-optical device according to claim 1, wherein the third transistor is in an OFF-state while the second transistor is in an ON-state.

6. The electro-optical device according to claim 1, wherein the second transistor is in an OFF-state while the third transistor is in an ON-state.

7. The electro-optical device according to claim 1, further comprising a enable line, wherein a gate of the second transistor is electrically connected to the scan line, and a gate of the third transistor is electrically connected to the enable line.

8. The electro-optical device according to claim 7, wherein a selection signal that makes the second transistor be in an ON-state is supplied to the scan line during a first period in which an inactive signal that makes the third transistor be in an OFF-state is supplied to the enable line.

9. The electro-optical device according to claim 8, wherein an active signal that makes the third transistor be in an ON-state is supplied to the enable line during a second period in which a non-selection signal that makes the second transistor be in an OFF-state is supplied to the scan line.

10. The electro-optical device according to claim 1, wherein a gate of the second transistor and a gate of the third transistor are electrically connected to the scan line, and the second transistor and the third transistor have polarities opposite to each other.

11. An electronic apparatus comprising the electro-optical device according to claim 1.

* * * * *